US008151985B2

(12) United States Patent
Owoc

(10) Patent No.: US 8,151,985 B2
(45) Date of Patent: Apr. 10, 2012

(54) CONTAINERS FOR STORING AT LEAST TWO SUBSTANCES FOR SUBSEQUENT MIXING

(76) Inventor: Greg J. Owoc, Greenville, SC (US)

( * ) Notice: Subject to any disclaimer, the term of this patent is extended or adjusted under 35 U.S.C. 154(b) by 607 days.

(21) Appl. No.: 11/766,930

(22) Filed: Jun. 22, 2007

(65) Prior Publication Data

US 2008/0314775 A1 Dec. 25, 2008

(51) Int. Cl.
*B65D 25/08* (2006.01)

(52) U.S. Cl. ..... 206/219; 206/222

(58) Field of Classification Search ..... 206/219, 206/222, 568; 215/228, 297, DIG. 8
See application file for complete search history.

(56) References Cited

U.S. PATENT DOCUMENTS

| | | | | | |
|---|---|---|---|---|---|
| 3,156,369 | A | | 11/1964 | Bowes et al. | |
| 3,802,604 | A | | 4/1974 | Morane et al. | |
| 4,067,440 | A | | 1/1978 | Lataix | |
| 4,177,938 | A | | 12/1979 | Brina | |
| 4,195,731 | A | * | 4/1980 | Cavazza | 206/222 |
| 4,247,001 | A | * | 1/1981 | Wiegner | 206/222 |
| 4,615,437 | A | | 10/1986 | Finke et al. | |
| 4,638,927 | A | | 1/1987 | Morane | |
| 4,781,679 | A | | 11/1988 | Lorkin | |
| 4,793,475 | A | * | 12/1988 | Itzel | 206/219 |
| 4,795,043 | A | * | 1/1989 | Odet et al. | 215/235 |
| 4,808,006 | A | | 2/1989 | Kaufeler | |
| 4,869,399 | A | * | 9/1989 | Dubach | 222/83 |
| 4,936,446 | A | | 6/1990 | Lataix | |
| 4,982,875 | A | | 1/1991 | Pozzi et al. | |
| 5,170,888 | A | * | 12/1992 | Goncalves | 206/222 |
| 5,217,433 | A | | 6/1993 | Bunin | |
| 5,419,445 | A | * | 5/1995 | Kaesemeyer | 215/DIG. 8 |
| 5,482,176 | A | | 1/1996 | Maietta et al. | |
| 5,543,097 | A | | 8/1996 | Fang | |
| 5,647,481 | A | | 7/1997 | Hundertmark et al. | |
| 5,788,076 | A | * | 8/1998 | Simmons | 206/497 |
| 5,811,060 | A | | 9/1998 | Laguna Valderrama | |
| 5,927,549 | A | * | 7/1999 | Wood | 222/83 |
| 5,992,668 | A | | 11/1999 | Elliott | |
| 6,047,818 | A | | 4/2000 | Warby et al. | |
| 6,073,803 | A | | 6/2000 | Sturm et al. | |
| 6,148,996 | A | | 11/2000 | Morini | |
| 6,481,571 | B1 | | 11/2002 | Kelders et al. | |
| RE38,067 | E | | 4/2003 | Gueret | |
| 6,644,471 | B1 | | 11/2003 | Anderson | |
| 6,655,524 | B2 | | 12/2003 | De Laforcade | |
| 6,655,525 | B2 | | 12/2003 | Song | |
| 6,655,553 | B2 | | 12/2003 | Staniszewski et al. | |
| 6,679,375 | B1 | | 1/2004 | Coory | |

(Continued)

*Primary Examiner* — Steven A. Reynolds
*Assistant Examiner* — King M Chu
(74) *Attorney, Agent, or Firm* — J. Bennett Mullinax, LLC

(57) ABSTRACT

A container for storing at least two substances separately, for subsequent mixing, comprises two storage chambers. Both substances are maintained separately through means of an intervening seal that in one embodiment includes molded threads on its inner walls, a breakable bottom, and a seal rim portion. Activation occurs when the first chamber is screwed downward toward the second chamber. A second embodiment includes the same seal, but with no threads and simply a press activation system within a bellows sleeve. The first chamber may include various cap means through which the mixed substances may be poured out, including screw, spouted, snap-fitted, and plug-types. The seals of both embodiments may be reconfigured into two parts to adapt to a modified second chamber to accomplish the same results. The container may be enclosed in tamper-evident film that includes a perforated pull strip. Both embodiments can be adapted for beverage, medical, cosmetic, chemical, and many other container applications.

26 Claims, 15 Drawing Sheets

U.S. PATENT DOCUMENTS

| | | | | |
|---|---|---|---|---|
| 6,695,829 | B2 | 2/2004 | Hellstrom et al. | |
| 6,705,490 | B1 | 3/2004 | Lizerbram et al. | |
| 6,716,396 | B1 | 4/2004 | Anderson et al. | |
| 6,763,939 | B2 | 7/2004 | Alticosalian | |
| 6,766,903 | B1 | 7/2004 | Yehhsu | |
| 6,772,910 | B1 | 8/2004 | Coory | |
| 6,814,229 | B2 | 11/2004 | Seckler | |
| 6,840,373 | B2 | 1/2005 | Gibler et al. | |
| 6,910,573 | B2 | 6/2005 | Deans | |
| 6,921,087 | B2 | 7/2005 | Takahashi et al. | |
| 6,935,493 | B2 | 8/2005 | Cho | |
| 7,025,200 | B2 * | 4/2006 | Fontana | 206/222 |
| 7,032,745 | B2 | 4/2006 | Saulle | |
| 7,172,095 | B2 | 2/2007 | Marshall | |
| 7,178,683 | B2 | 2/2007 | Birkmayer et al. | |
| 7,210,575 | B2 | 5/2007 | Oswald | |
| 2002/0020636 | A1 | 2/2002 | Beramini et al. | |
| 2005/0016875 | A1 | 1/2005 | Rodriguez | |
| 2005/0205438 | A1 * | 9/2005 | Hierzer et al. | 206/222 |
| 2005/0218015 | A1 | 10/2005 | Spector | |
| 2006/0144727 | A1 * | 7/2006 | Fontana | 206/222 |
| 2006/0289316 | A1 * | 12/2006 | Henry | 206/219 |

* cited by examiner

Figure 2.1

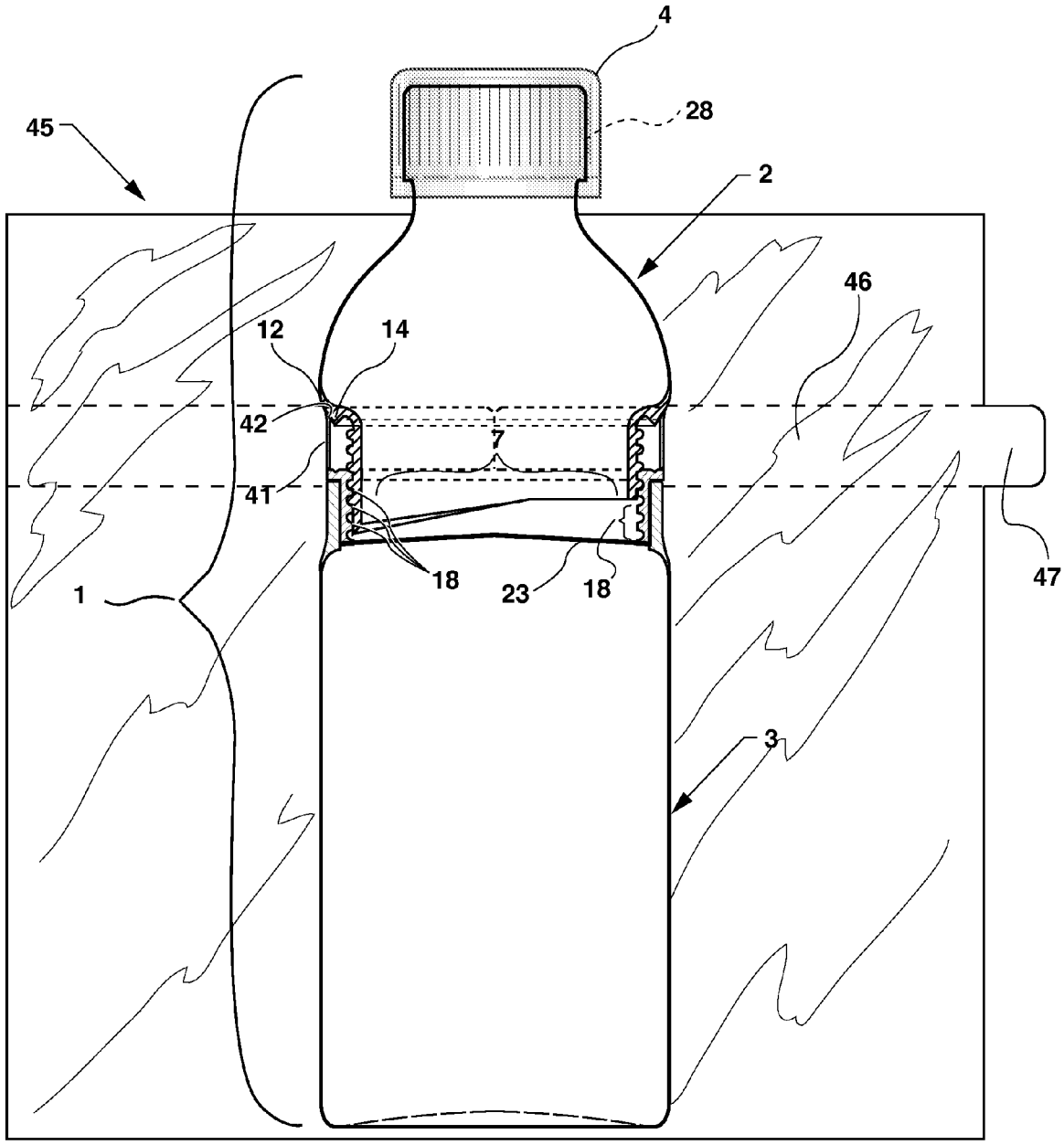
*TAMPER-EVIDENT FILM WITH PERFORATED RIP STRIP*
*Figure 2.2*

(TOP VIEW)

(SIDE VIEW)

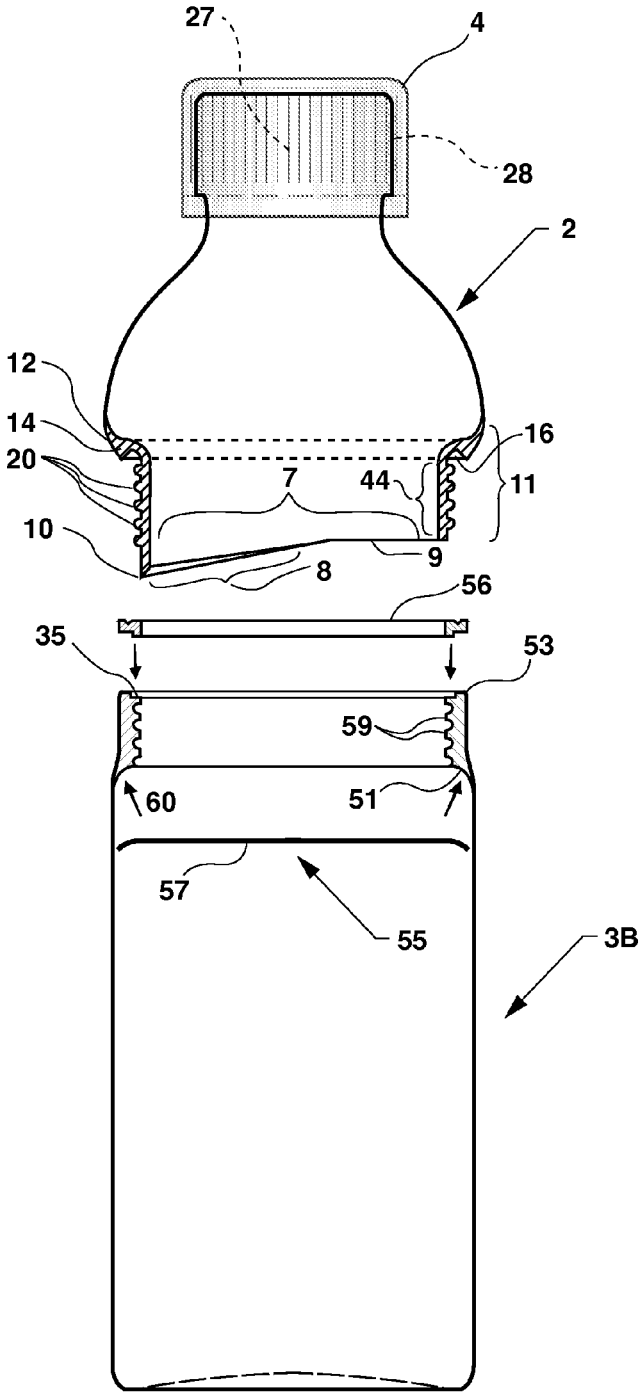
Figure 8
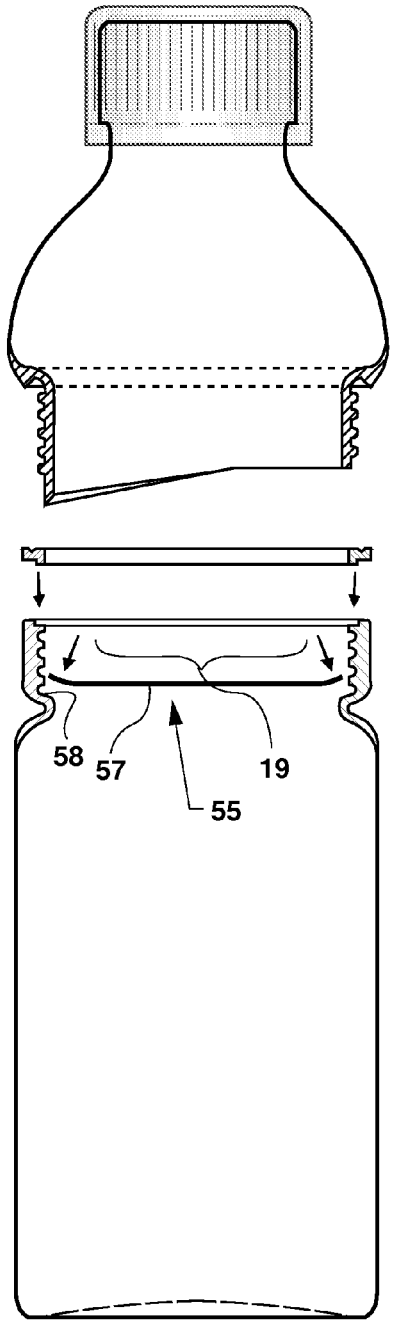
Figure 8.1

*TAMPER-EVIDENT FILM WITH PERFORATED RIP STRIP*

CONTAINERS FOR STORING AT LEAST TWO SUBSTANCES FOR SUBSEQUENT MIXING

BACKGROUND OF THE INVENTION

I. Field of the Invention

The present invention relates to containers which can hold two or more substances, yet keeping them separate without them contacting one another, so as to be able to mix them later at preferred time of use. The present invention relates particularly to a more efficient, unique, two-embodiment design that requires fewer, simpler parts that are easily manufactured, low in cost with easily assembled components of a disposable, recyclable, mass-producible container.

II. Discussion of Prior Art

Containers that keep two or more substances separate for later mixing are known to be used in several industries, for example the medical-pharmaceutical industry, where medicine mixtures must be kept unmixed until time of patient use. In this instance, typically there is a powder medicine that needs to be combined with a liquid medicine. A pharmaceutical container of this purpose is disclosed in U.S. Pat. No. 4,982,875 wherein an internally threaded cap drives down a delivery piston that has a cutting edge designed to pierce a medicine reservoir upon twisting the cap. It is a useful device, but as in many of the medical related containers of this type, it has the serious shortcoming of being able to mix only a small payload of powder in proportion to the total mixture solution.

In the chemical industry, this type container system is used often for hardening resins and the like that react rapidly and must be used immediately once they are mixed. U.S. Pat. No. 4,808,006 discloses such a two component resin container that has a dividing membrane piece separating two resin substances. The membrane may be pierced by an annular cutter that can be both rotated and pushed into a cutting motion through an external rod attached thereto.

Another functional use for a container of this sort is an infant's bottle, as that in U.S. Pat. No. 5,419,445 where a powder is loaded into a reusable, nipple assembly and baby bottle that may also have the liquid preloaded into it, thus providing a fresh beverage at the time of mixing.

In the mainstream beverage industry, wherein the present invention is not limited to, but for which it is primarily designed, there have been devised, as well, several containers of this sort. For example, U.S. Pat. No. 6,148,996 discloses an externally threaded container portion inside which a capsule is inserted. The double-nested cylinder cap has a moveable cutting element mold-nested inside of the cap, the outside molded sleeve part of which has internal threads that mate with the external threads of the container portion.

While the above container is a compact design, an improvement over prior art, and effective in keeping the substances separate and able to be mixed at later time period, this structure has shortcomings. First, it is a difficult mold process to make the double nested sleeve cap. Second, as in nearly all these systems including those discussed above, the ratio or what normally is a powder substance to a liquid substance is low, since the caps are necessarily small in relation to the liquid reservoir into which the powder is mixed. As to function, it being necessary to take the rather large and bulky cap off of the container portion after activating and mixing both substances to drink the mix is inconvenient because it leaves a sharp cutter exposed, adding to possibility of injuring the user, as well as leaving an open cap dripping with the mixture.

These factors add to the possibility of staining surroundings and also the inconvenience of disposal of two substantial container pieces.

It is to be noted that US Patent Publication No. 2005/0016875 A1 is a remarkably similar structure to the '996 patent above, differing only in the fact that the cap portion has an additional opening in the top of the internally threaded screw cap, whereby the opening comprises a detachable plate piece. The advantage over 996 is that the large nested cylinder screw cap does not need to be removed, just the secondary cap, after activation and mixing. However, the drinking orifice then leaves a thick rim edge from which the user is to drink and presents an inconvenience to the user. As well, a detachable cover is not easily put back on and off until the drink is consumed and may not be as leak-proof and secure as a traditional screw cap.

One of many novel features of the present invention is to include a simple screw cap opposite the end of that open end of the first chamber. This unique, additional screw cap feature enables the present cap systems of the above two structures to be transformed into a novel, spacious chamber system that allows almost limitless capacity in ratio of the substances the container can manage mixing.

U.S. Pat. No. 3,156,369 discloses a press pierce chamber system, whereby a small cap plate must be broken to gain access to a push-activated cylinder top portion, having a cutting element on its opposite end, that upon pressing slides down a reservoir chamber, or seal member with a breakable bottom, and the cutting element pierces the bottom seal and releases the substance into a second chamber, that comprises a liquid. This system holds little substance capacity and has a serious risk of leakage, as opposed to the present invention. Additionally, it is more complex to manufacture, as well as more complex to activate from a shelf-ready state. It is cited to be representative of most of the limitations of press-activation patented art at present.

A totally non-threaded press-seal system for the beverage industry, disclosed in U.S. Pat. No. 7,025,200, describes a container by which downward pressure on a cylindrical portion loaded with a mixture then pierces a powder reservoir bottom. Though compact, and effective in mixing its two substances, this structure has the disadvantage of risk of leaking, since the final press seal is fitted only by pressure and not through the reliable screw cap, a typically more trustworthy sealing means. The push portion of the cylinder breaks off during activation and in order to drink the container's contents and it cannot be put back on in a sturdily leak-proof manner, which is an inconvenience with this container, as well.

SUMMARY OF THE INVENTION

One main object of the present invention is to provide a generic two-substance mixing container that can be adapted to function in the above medical, chemical-industrial, cosmetic, and infant formula applications, and most importantly in the beverage industry, in such a way as to alleviate the above shortcomings of the container structures discussed, and introduce new improvements and advantages in the structure, as well.

The second objective is to provide a container that has almost no limitation to the ratio amounts of dry powder payload to liquid substance intended to be mixed. This is important in many of the protein drinks on the market in which the density of the protein powder is low, but the liquid to be combined with it is high in density. This necessitates a proportionately large powder chamber to get for example, a 16 or 20 ounce drink to a proper viscosity. While some structures attempt to provide for this feature, as those found in U.S. Pat. Nos. 5,647,481, 6.073,803, and in US Publication No. US2002/0020636 A1, most are complicated in their structure, and others are limited to bottle container caps that themselves are too small and restrictive by their closure diameter, and thus their corresponding reservoir or substance chamber cannot function to provide a large powder to liquid volume ratio. Since the present invention uses the girth or diameter on the open ends of the container at the seal mating portion of the container's chambers, rather than the typical small bottle closure orifice or substance filling portion, the chamber can be quite large and accommodating to meet this volume ratio objective that is a shortcoming in the present containers.

Another objective is to highly simplify the container to three or four total simply manufactured parts, namely two substance holding chambers (these can be molded through blow mold processes, rather than more expensive injection molding), one seal, and an optional fourth piece which in the preferred embodiment is a screw cap on one of the container's chambers. It is an environmental objective to manufacture all the three of four parts used to accomplish the mixing container, in recyclable polymers, and keep the total container weight at a minimum near what present disposable beverage and other liquid retaining containers require at present.

A truly novel feature of the invention that results in an objective of simplicity of design is the fact that internal threads are introduced on the seal itself, allowing the two chambers to be manufactured with low-cost blow mold parts, it not being necessary to inject mold, even if it could be done, on one or both the chamber parts. The seal serves multifunctionally also in that it is a dual purpose seal, sealing both before and after activation, being a tamper evident seal that is optionally one-way locking with respect to the two chambers rotation.

A fourth objective is to cosmetically have a container shape that looks very much the same as standard blow mold bottles into which many of our common beverages are packaged in at present.

A fifth object of the invention is to include an optional protective outer strip that helps keep one chamber's, preferably powder substances fresh, minimizing air exposure, thus promoting long shelf life. The outer strip also serves as a tamper evident means if one of the substance storing chambers were moved out of position with respect to one another, revealing if the seal had been tampered with or broken in any way. Another objective with this protective seal is that it can be permanently sealed using glue or a snap fit lip, flange or ring, so that an additional air tight seal may be achieved until activation.

Another sixth objective is to provide a tamper evident film wrap that requires a perforated strip to be removed by the user before activation and mixing can occur. Thus, the film would serve as an additional tamper proofing safety feature.

Since the preferred embodiment includes a first chamber that has threads on both open ends, it may be a necessary objective to provide a glued portion, or one-way ratchet teeth on the seal mating portions of that chamber and seal so that the container cannot leak by a user unscrewing the chamber and unseating a mating seal from its position.

It is also an objective to provide variations of the structure, including a modified two-piece seal, rather than a one piece seal to give manufacturing options as to how the container is made for a given industry purpose.

It is another purpose to provide a container that when activated, displaces a minimal amount of volume, yet mixing large or small proportionate ratios of two substances with one another.

Lastly, the invention intends to provide a container user with a normal bottle-like usage experience, that is free from the inconveniences and encumbrances of the above prior art containers. For example, drinking a beverage, preparing a baby bottle, or mixing a medicine with minimal activation labor necessary is also an objective by providing a standard screw cap, its geometry not being dependent on the ratio of the substances volume the container must have. As well, a syringe bottle is disclosed that uses the invention's structure in a smaller format for a key and needful application for the medical industry, especially for diabetics, whose insulin potency could be maintained with such a fresh activation system.

The present invention is of the above type of container that has at least two separate storage chambers for storing at least two substances separately, for subsequent mixing, that comprises one container portion that forms a first chamber that encloses a first substance, preferably a powdered substance. This first chamber comprises an open end upon which is a seal mating portion proximate or near its outer periphery. This open end also incorporates a seal breaking element that may be comprised of a annular cutting edge, that is simply molded into and with the chamber in a preferably blow mold process.

There is a second container portion that is a second chamber that encloses a second, preferably liquid substance. This chamber also comprises an open end that has a seal mating portion, preferably in its inner periphery. Between these two open ends of the chambers and their seal mating portions, there is a seal situated. The seal is preferably fitted in the open end of the second chamber and may be glued, induction sealed, RF or heat sealed or ultrasound welded at that opening. The seal comprises a breakable bottom which is broken as the first and second chambers are moved toward each other, causing the cutting edge to move down upon the seal's bottom cover, thus allowing the two substances to mix together, as the user shakes the activated container. The seal mating portions meet together, as well, as the chambers move together, being intervened by the seal's annular rim portion, that is preferably permanently sealed into the second chamber's open end, in assembly, and it retains the unmixed liquid therein.

Though the two chambers can be moved together and the breakable, non-threaded seal broken with the cutting edge simply by pressing them together, as will be described in one of two preferred embodiments, it may be preferable to use threads inside the plug or cup-like seal. Those threads would mate with external threads proximate to the first chamber's open end. The chambers then only need twisted, clockwise with respect to one another to effect the linear movement together to activate the breaking of the bottom seal and reseal the container at the seal's annular rim portion and the chamber's seal mating portions. At that point, the container is shaken and the preferably liquid and powder substances are mixed and then may be poured out for their industrial application, or in the case of a beverage, to be drunk.

By including a simple screw cap opposite the end of that open end of the first chamber, a substance filling opening is provided for quick powder or liquid loading in assembly. As well, a screw cap is the logical standard beverage industry closure cap that can fit on a formed threaded bottle mouth on the first chamber for drinking or pouring out liquid substances, though other type caps are discussed herein, such as a snap-fitted cap or modified plug cap, or even a nipple-tipped baby bottle cap, and others, such a tear away tip caps for resin mixing, or even a syringe bottle cap with characteristic center piercing rubber insert, as the above are illustrated in the following specification.

Though not a preferred cap embodiment, the present invention may allow the first chamber to be removed after activation and the user may drink. This modification simply excludes the substance filling opening for the first chamber, and instead leaves the only the one opening on the chamber. The first chamber, after activation, is detachable from the container so that after mixing the said first and second substances, it may be removed, allowing the user to empty or drink directly from the open end of said second chamber. Thus, the first chamber itself, becomes the screw cap, itself. Filling would simply be effected in assembly by screwing into position the already filled sealed second chamber, upside down onto the threads of the first chamber.

Another modification includes a second chamber that has threads internal to its open end and a seal that comprises two parts instead of one part. The seal comprises a ring seal situated in a approximately the same place as the former seal's annular rim portion, and then a disc seal situated in a approximately the same place as the former seal's bottom portion.

To effect a linear movement together of the chambers that requires less rotation or twisting of the chambers with respect one another, it may be useful to use mating, multiple-lead threads on the container parts, which would result in a quicker activation and less work for the container user.

The seal is preferably made of EVA material, which is both conducive to sealing well on the rim portion, while having the consistency to provide stiff enough of a material for threads for excellent movement of the two chambers and for a good shearing around the bottom inner edge of the seal during activation. The lubricity of EVA also is an advantage in these multiple functions this unique seal performs.

It may be necessary to permanently seal the first chamber to the seal's annular rim portion after activation, though the applicant believes the seal will remain tightly intact, even when opening the screw cap through which to pour out the liquid mix. Nevertheless, the first chamber's open end may include a chemical applied surface and wherein the seal's annular rim portion may have chemical applied surface being chemically bondable to one another upon mutual contact to permit a non-rotatable sealing contact of the said first and second chambers with respect to each other after breaking of the seal bottom occurs.

As well, the first chamber's open end may further include one-way ratchet teeth and also the seal's annular rim portion may have one-way ratchet teeth. These one-way ratchet teeth of both these pieces may mutually engage to permit rotation of the said first and second chambers with respect to each other in only one direction, after activation has occurred. The teeth may also additionally be on the protective seal as well, locked into position in assembly and then reset into position at activation where the first chamber can never be reversed into an unscrewed position.

An optional protective outer strip maybe included on the seal rim portion's periphery, which tears away from the seal rim portion of the seal as internal bursting pressure is applied proximate to the first chamber's seal mating portion, as the first and second chambers are linearly moved with respect to each other. The protective outer strip may further comprise an outer seal split section which splits open as the first and second chambers are linearly moved with respect to each other.

This protective outer strip may be chemically or otherwise adhered or bonded through glue, RF, heat, ultrasound, induction sealing, or other bonding technologies used in the container industry in assembly. The strip would be located proximate to the outer periphery of the seal mating portion of the first chamber; and would tear away from the seal rim portion of the seal as twisting rotational force is applied to the first chamber in activation of the said container. The protective outer strip could remain permanently bonded to the periphery of said first chamber's seal mating portion, as said first and second chambers are linearly moved with respect to each other.

As well, the seal may further comprise a protective outer strip which is bonded in assembly proximate to the outer periphery of the seal mating portion of the first chamber; and is designed to tear away from the seal rim portion of the seal as twisting rotational force is applied to the first chamber in activation of the container. However, while it tears away from the seal rim portion, the protective outer strip remains permanently bonded to the said periphery of said first chamber's said seal mating portion, as said first and second chambers are linearly moved with respect to each other and the seal continues to remain on the outside body of the container. This lessens debris and the inconvenience of handling the seal after activation has occurred.

On the outside of most containers, especially in the beverage industry, a protective film or shrink wrap is used that also includes the graphics and advertisement of the product. In the present invention, a tamper evident outer film with a perforated strip is placed in approximate annular alignment to the seal's protective outer strip. This perforated strip includes a pull tab which upon pulling allows the perforated strip to be pulled from the container circumference, enabling protective outer strip to detach and allow the two chambers to be rotated with respect to one another. This allows the chambers to travel linearly with respect one another, thus enabling the seal breaking element to break open the seal bottom and the substances to mix.

The protective outer strip may instead comprise a tamper-evident flange that cooperates with a flange-receiving portion proximate to the outer periphery of the said seal mating portion of the first chamber. These two flanges are mating and may snap-fit into position with one another, providing a firm seal at their contact surfaces. The protective seal would tear away from the seal rim portion of the seal as twisting rotational force is applied to the first chamber in activation of the container, as the first and second chambers are linearly moved with respect to each other.

It is to be noted that in the second embodiment includes the same basic seal, but with no threads being used to moved the chambers into cutting contact with one another. The linear movement is effected simply through a press-activation system whereby a bellows sleeve that is located on the periphery of the open end of the first chamber's open end, proximate to its mating seal portion, and is sealed at production. The user pushes the top of the container to activate, after removing a protective film outer seal that is around the bellows in the container's shelf-ready state. No leakage occurs since the bellows is already sealed on the seal mating portion in manufacturing assembly.

It may be preferable to include, however, at least one air vent, which may comprise any of the following: air hole or air opening, as a slit or perforation of any type that would let air into the container, upon press-activation. Such an opening in the bellows would allow air to escape the container and permit the bellows to collapse with the pressure of the activation. This pinhole could be located in a portion of the bellows that gets tightly compressed in the activation position, and thus make leakage highly improbable, since the liquid would have to get through at least one annular sealing ring is molded around the cutting edge of the of the first chamber proximate to said first chamber's open end, which tightly mate with a molded groove in seal's inner walls. The annular sealing ring may snap into position, when the said seal bottom is opened by the linear movement of the cutting edge upon it. Similar to the threaded seal container embodiment, this press-activation bellows container further may comprise an outer tamper resistant film that covers at least an outer portion covering the bellows sleeve. The film may be torn away from the container, allowing for activation by a user at time of activation.

Lastly, the seal in the threaded embodiment may have another ring seal placed over its rim seal portion, such as in an induction-type seal, where aluminum and a polymer film are bonded and then sealed at time of induction sealing during container assembly. This allows for a secondary seal around the rim of the seal to be added in the event the seal would not be made itself of a sealing material suitable for effective sealing purposes around the edge, though sufficient for the sealing purposes in the second chamber.

The above summary is general and serves as an overview of the invention. Further features and modifications besides those summarized will be described in the following description. It should be obvious to one skilled in the present art to see possible general modifications that may be substituted for those employed to achieve the purposes of the present invention, while not departing from the spirit or scope of the present invention. In addition, further characteristics of the invention may be understood by the following description and drawings, the preferred embodiments of which are by way of example and non-limiting to the spirit and scope of the invention.

BRIEF DESCRIPTION OF THE DRAWINGS

FIG. 2.1 is a magnified illustration of the seal area of the present invention.

FIG. 2.2 is an assembled illustration of the present invention sealed and ready to activate in front of a tamper evident film.

FIG. 8 is an exploded part illustration of the present invention in alternate embodiment with two-part seal.

FIG. 8.1 is an exploded part illustration of the present invention with an optional modified two-part seal of FIG. 8.

DETAILED DESCRIPTION OF THE PREFERRED EMBODIMENTS

Figure 1:
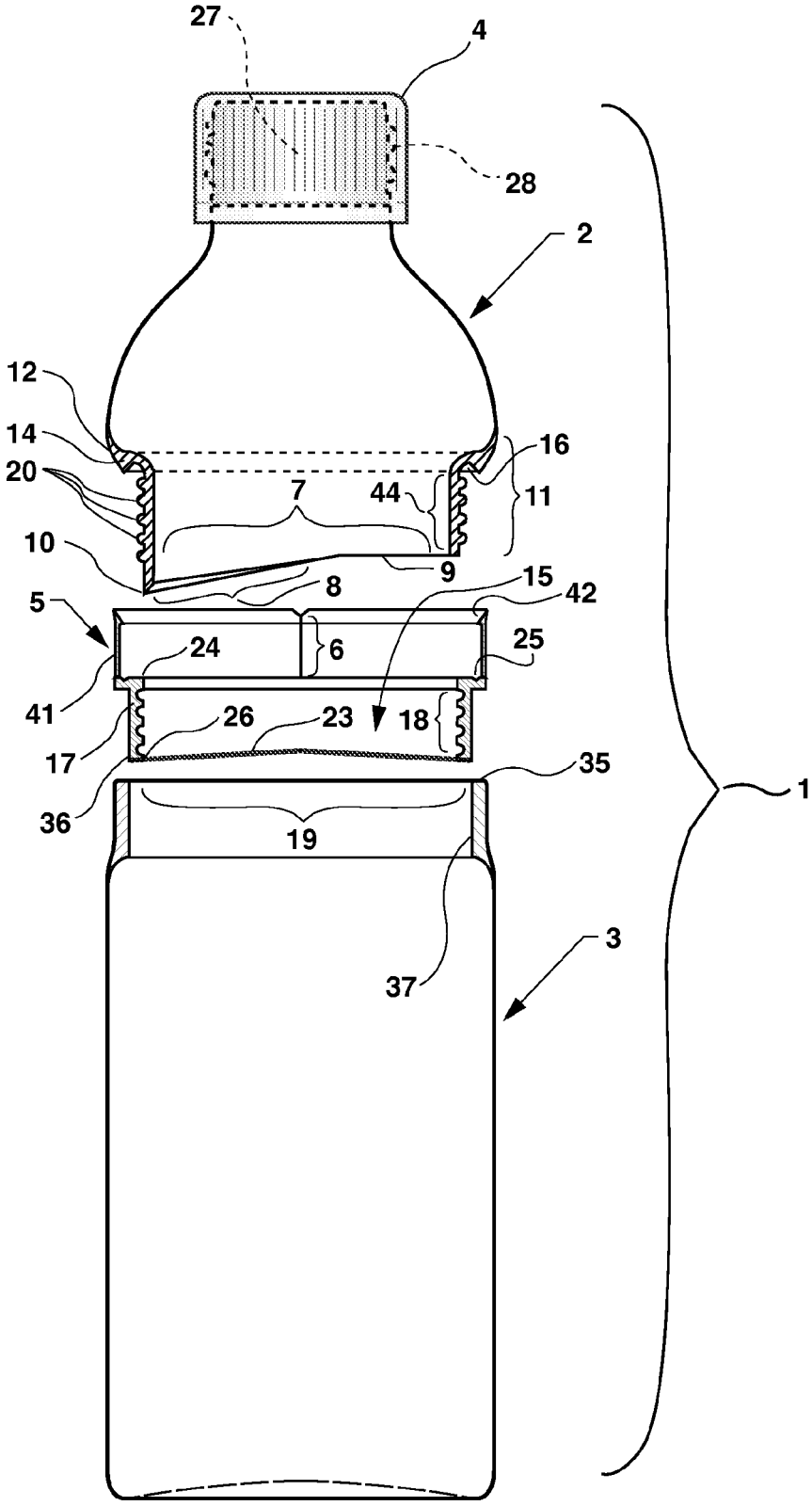
FIG. 1 is an exploded parts illustration of the present invention preferred embodiment.
Figure 2:
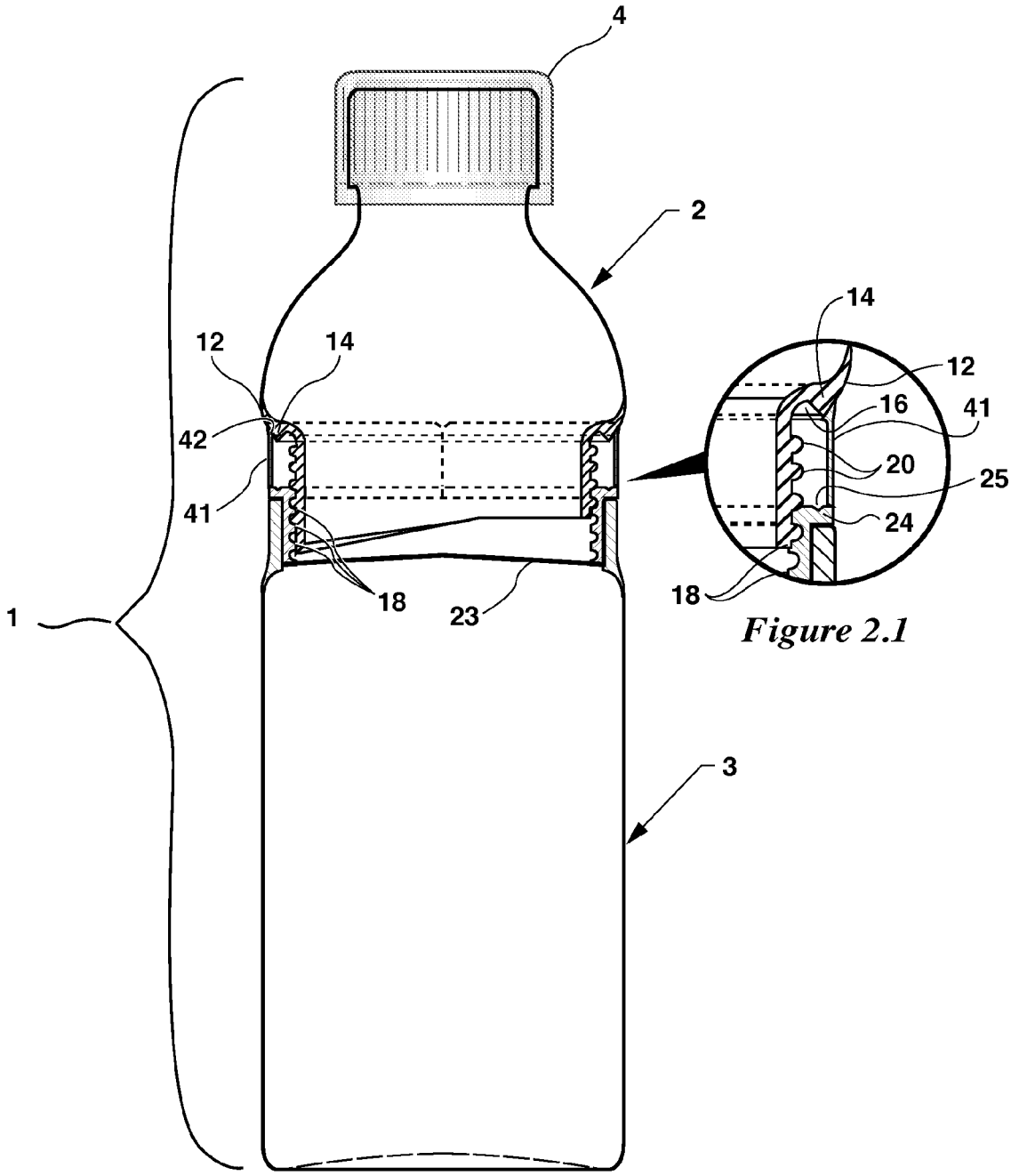
FIG. 2 is an assembled illustration of the present invention sealed and ready to activate.
Figure 3:
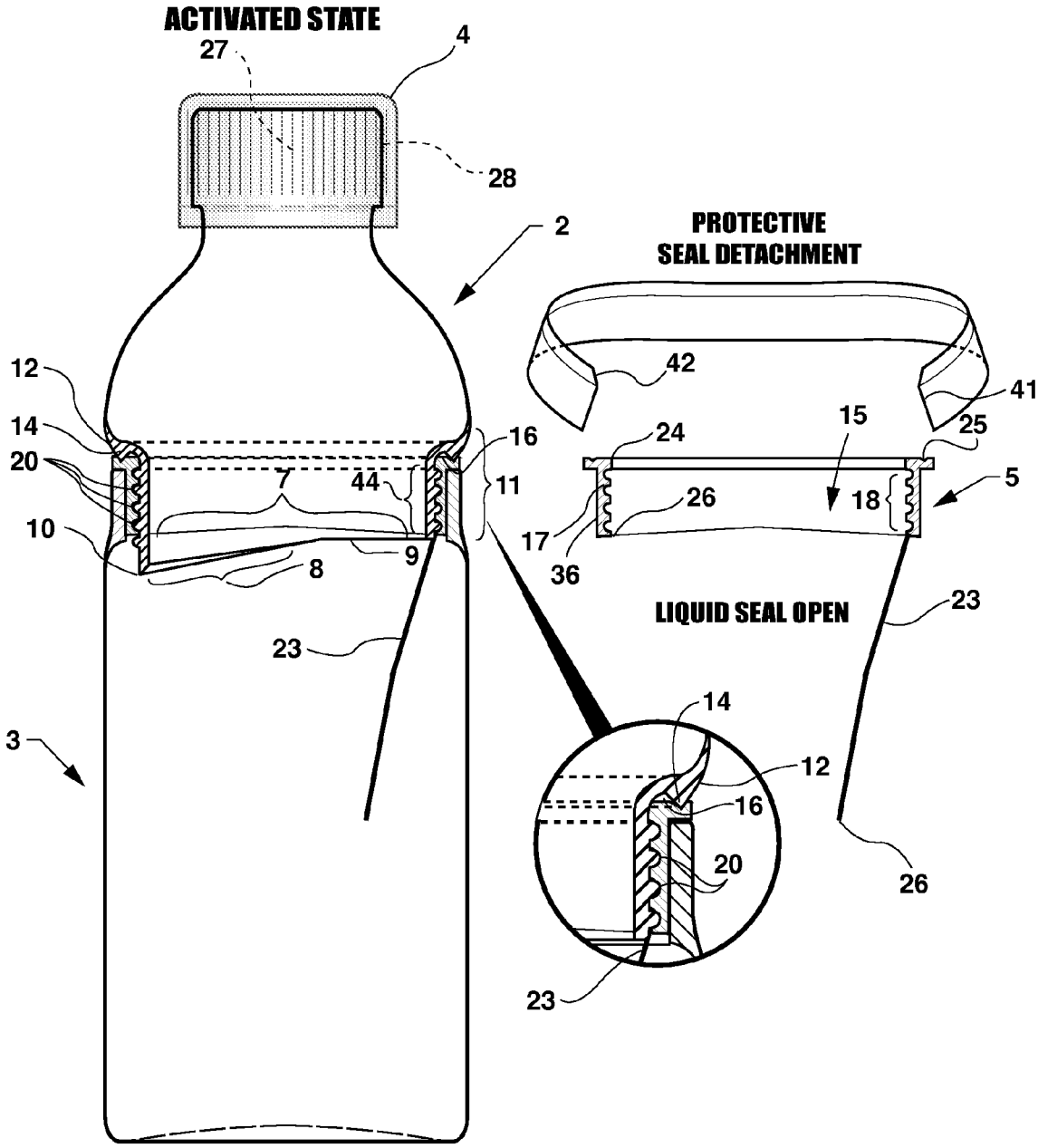
FIG. 3 is an assembled, activated state illustration of the present invention.

Noting FIG. 1, FIG. 2, FIG. 2.1 and FIG. 3, the container 1 comprises a first chamber 2, resembling a cylindrical bottle top portion, which has an open end 7 being formed as a cylinder with a seal breaking element 9, having a lower extremity 8, which further includes a machine cut, molded or formed cutting edge 10. Said first chamber's open end 7 further comprises an inner periphery 44, and outer periphery 11 that has a seal mating portion 12, which is simply described as an annular lip that may have an annular V-portion 14, which is shaped as a V-groove or V-channel thereon. It is to be noted that many different shapes or grooves can be used instead of the annular V shape, as shown. Simply a flat lip or edge or semicircular round edge, as well as a squared off edge annular shape, can work effectively for the sealing the said container 1 upon activation, may be used instead. As well, annular undercut 16 may not be necessary to include when molding the said first chamber 2, specifically blow-molding, which is an economical manufacturing objective chosen for the majority of the said container 1. This said undercut relief 16 is given to simply allow room for what may be the deformation of the said seal's 5 said annular seal rim portion 24, which is located at the top of an annular cavity 15 in said seal 5, as it seals down and is squeezed against the said first chamber's said annular V-portion 14. This said undercut 16 simply allows a relief area that may help this material to flow under pressure.

Figure 4:
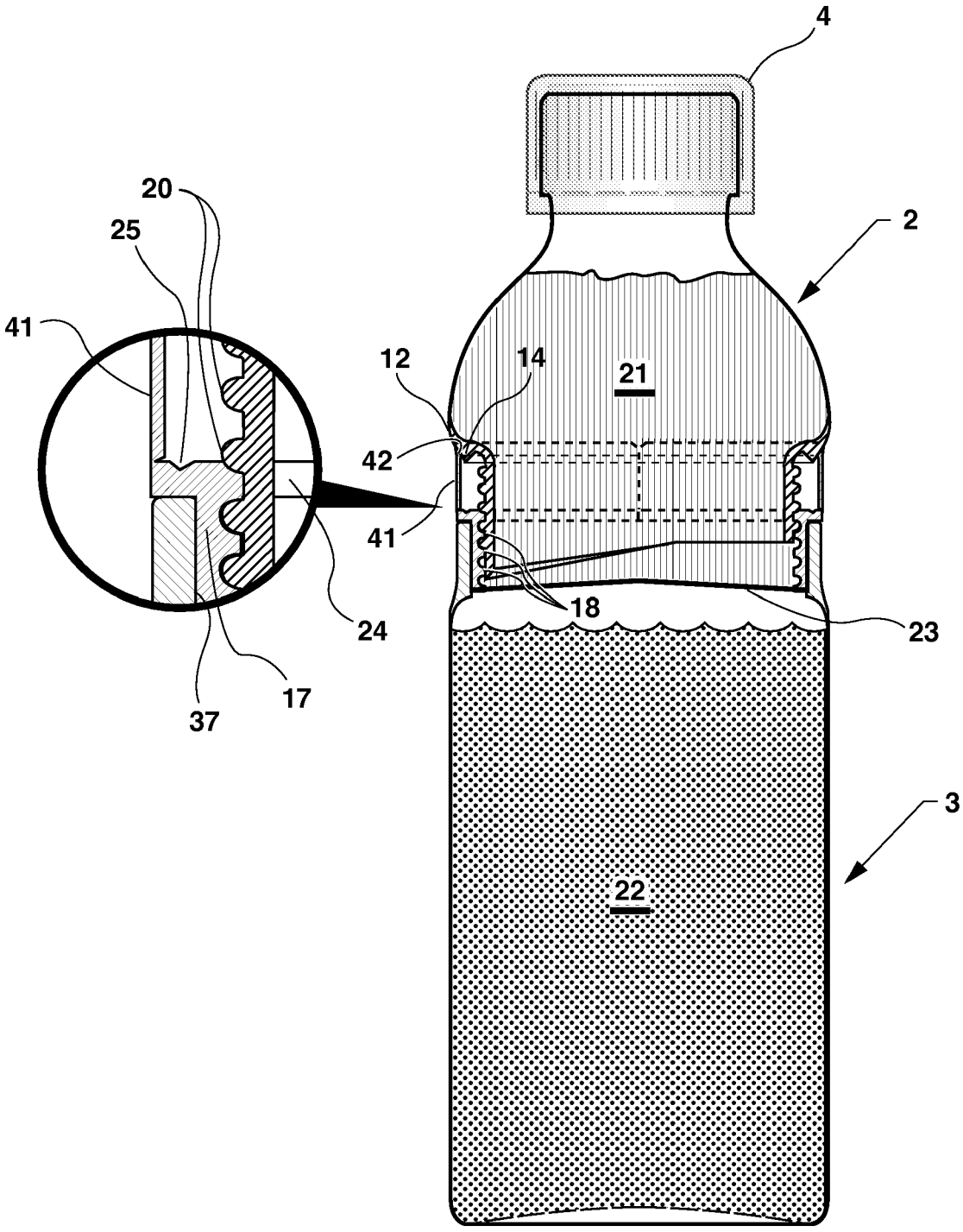
FIG. 4 is an assembled illustration of the present invention sealed and ready to activate with substances inside the container.
Figure 5:
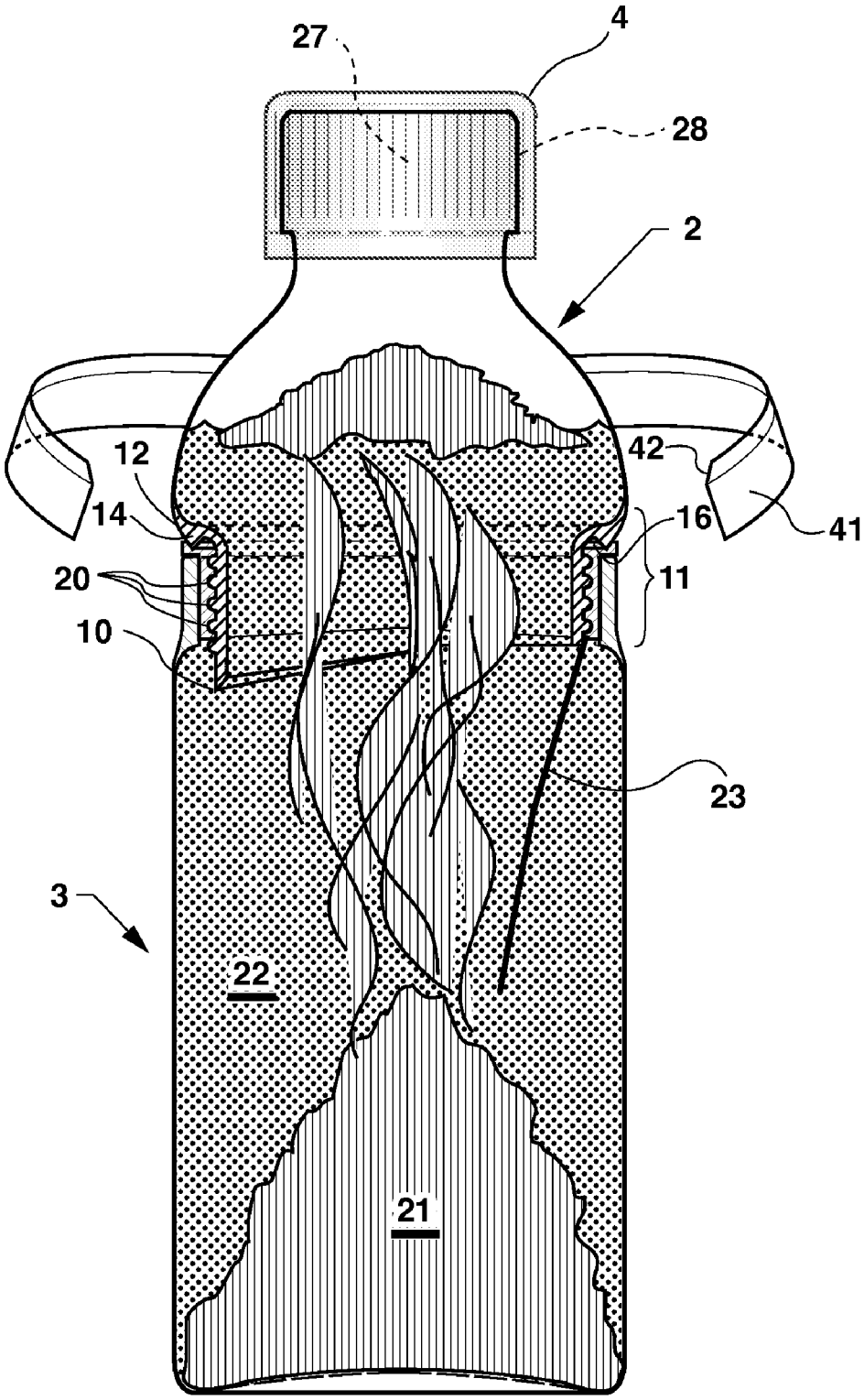
FIG. 5 is an assembled, activated state illustration of the present invention with substances inside the container activated and mixing.

Said outer periphery 11 further comprises external threads 20 that rotatably mate with internal threads 18 located on the inner walls 17 of said seal 5, which seal is situated between the said open end 7 and said seal mating portion 12 of first said chamber in both inactivated container state, as in FIG. 2 and an activated state, as in FIG. 3. The said seal 5 is also situated between an open end 19 located on a second chamber 3 and said seal mating portion 35 of second said chamber 3, whereby said seal 5 simultaneously, separately seals, noting FIG. 4 and FIG. 5, a first substance 21, preferably dry powder, or the like and a second substance 22 from one another, while serving also to structurally co-join said first and second chambers, 2,3, respectively, as a single said container 1 with said first and second substances, 21, 22, respectively, in an unmixed state, as illustrated in FIG. 4.

Said seal 5 further comprises a breakable seal bottom 23 which is broken as said first and second chambers are linearly moved with respect to each other as a container user twists them with respect to each other. This enables said seal breaking element 9 to move down upon and break open said seal bottom 23, at seal bottom edges 26, allowing said first and second substances, 21, 22, respectively to mix together as said first and said second seal mating portions, 35, 12, respectively, meet with intervening annular seal rim portion 24 located on said seal 5. Said container 1 thenceforth maintains the said mixed substances in the sealed, said container, until releasing said mixed substances. As the container is activated, that is, the said first chamber 2 is tightened with respect to the second said chamber 3, the said annular V-portion 14 meets a seal rim receiving groove 25 located within the said annular seal rim portion 24, so that a tight closure is maintained and the container can be then shaken and then drank or stored without any risk of leakage. Again, this is only one of many configurations that the sealing shape or format may use.

The said threads 18 on the said seal's 5 and the said first chamber's 2 mating threads may be made multiple-lead threads, enabling a long linear travel distance of said seal breaking element through a minimal rotation requirement of the first and second chambers, 2, 3, respectively, in relation to one another. This thread design is commonly used on any bottle caps in the beverage industry and it is desirable to have the said cutting edge 10 make one or just short of one revolution during activation.

It is to be understood that the said cutting edge 10 and the way it is arranged with the said lower extremity 8 can be modified in many different configurations to anyone familiar with the art, such as including multiple cutting edges, instead of one single annular edge, as in said cutting edge 10. As well the cutting angles could be changed to a steeper or even a more shallow angle than that illustrated. It may be desirable to fully sever the said bottom seal 23, rather than keep the seal hanging and still attached at one point, as illustrated. There could also be molded, machined or otherwise formed lips, edges or ridges formed on the inside of the said cutting edge 10 that may be beneficial to keep the detached said seal bottom 23 from jamming or plugging up into the said first chamber's open end 7 during the twisting activation stage of the said container 1.

Now noting in addition, FIGS. 7A, 7B, 7C, 7D, 7E, 7E, 7F, in FIG. 7, wherein the said first chamber 2 may include a second open end 27 that is located opposite the said first chamber's open end 7 which becomes both a substance filling opening, for use during assembly, when preferably a powder is loaded there through. As well, this second opening 27 serves as a pour spout that is typical bottle top in the standard beverage industry containers. The cap means 4 shown is a screw cap type, but may be configured into many other cap means for specific container purposes.

Other cap means illustrated are a snap-fit cap 29 with snap-fit orifice 32 and a modified plug-fit cap 31 with plug-fit rim 34, or screw on cap 4. All the above caps may have a knurled annular surface 30, whereby twisting a detachable first chamber 2*b* is easily accomplished. Said screw cap 4 is the preferred cap embodiment, but it is to be noted that the said container 1 can be fully functional, noting FIG. 7A and FIG. 7B, with just three pieces. Specifically, the said chamber 2*b* can be itself detachable from the said container 1 and screwed down in activation, the container shaken up, the contents mixed, and then this same said detachable first chamber 2*b*, comprising single opening screw chamber 33, removed and the user drink right out from the said second chamber's 3 seal mating portion 35 of the said second chamber's 3 said open end 19.

Figure 7A:
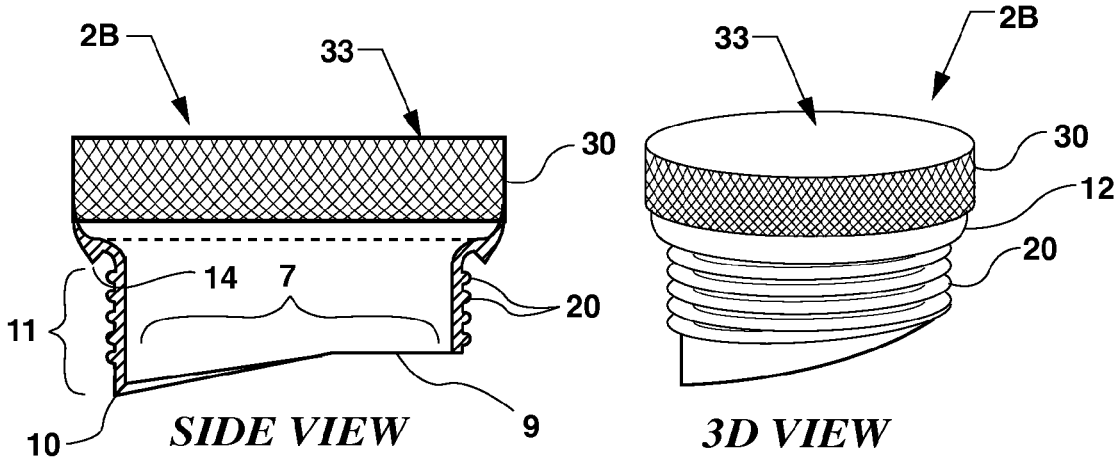
FIG. 7 comprises alternate first chamber FIG. 7A and alternate first chamber and cap views FIG. 7B, FIG. 7C, FIG. 7D, FIG. 7E, FIG. 7F
Figure 7B:
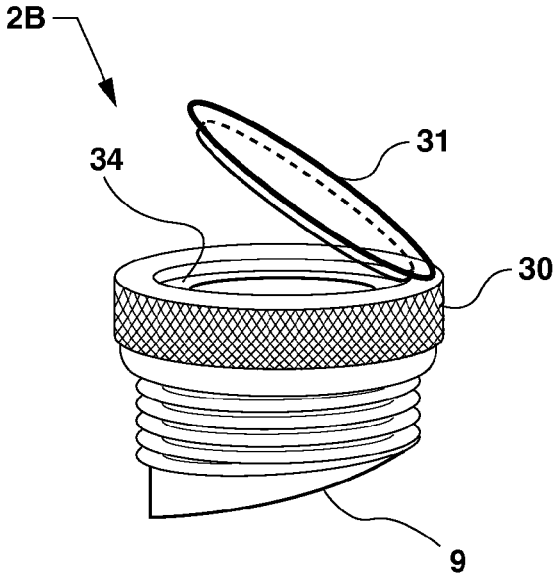
Figure 7C:
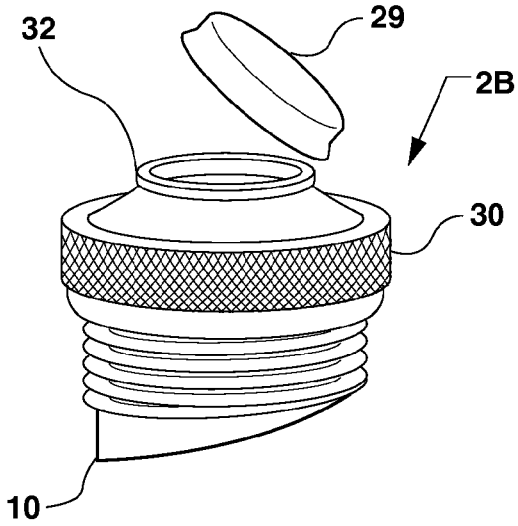
Figure 7D:
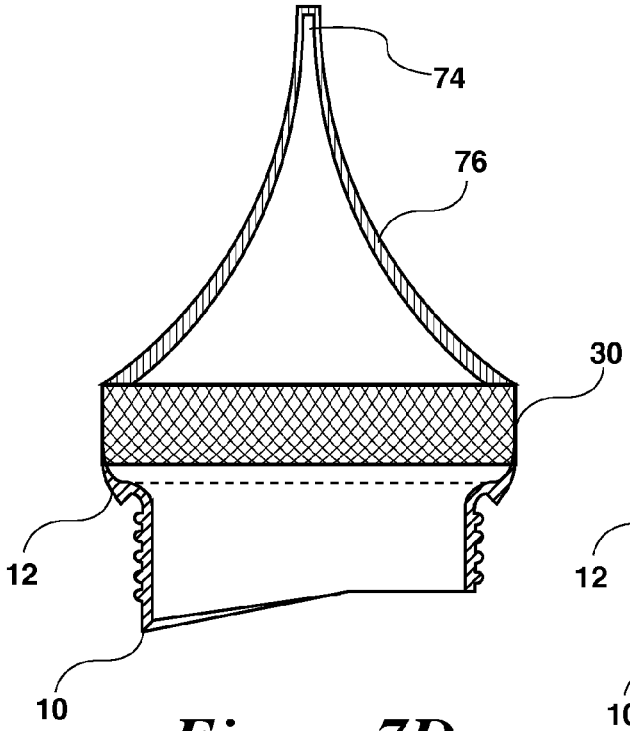
Figure 7E:
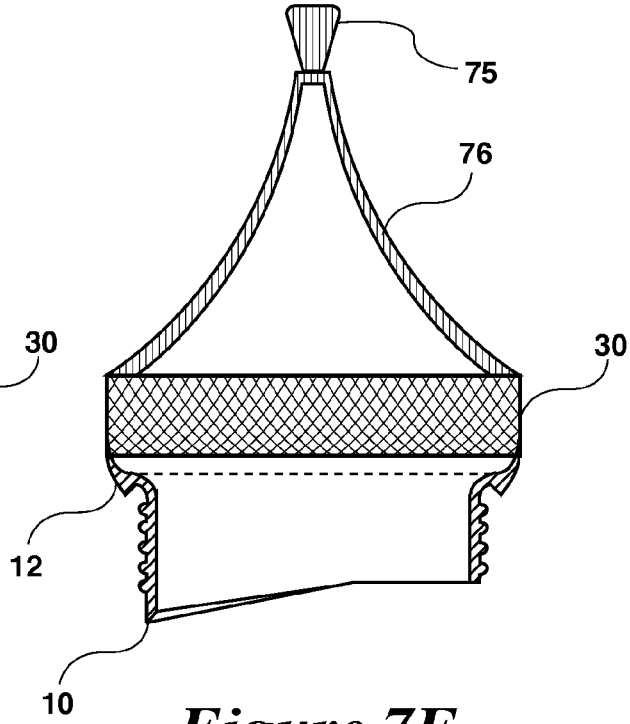
Figure 7F:
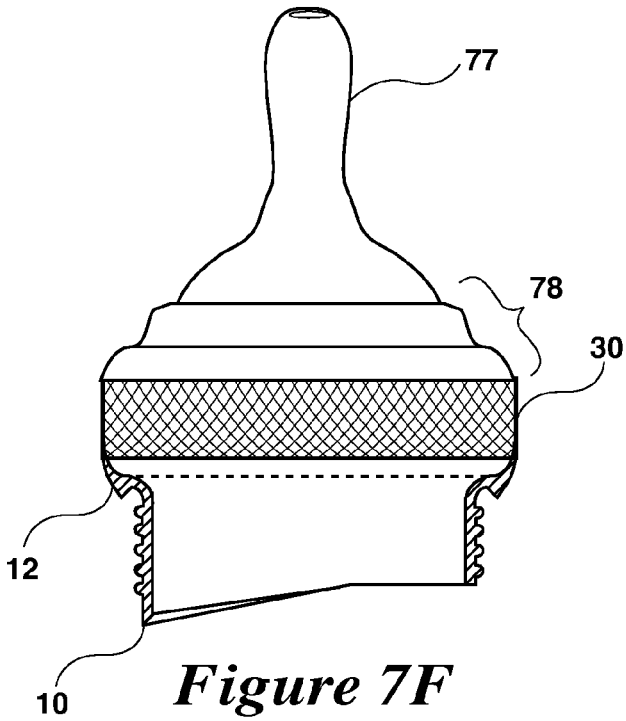

Noting FIG. 7D and squirt spout tip 74 that forms a terminus at the end of a taper 76 that in FIG. 7E may have a breakable tab 75 The purpose for this cap modification is for using the said container 1 for cosmetic applications, such as hair dye mixtures. Additionally, this cap structure could be used for industrial uses, resin mixing solutions. As well, the said cap means 4 can be a baby bottle nipple 74 could be snap-fitted upon the said modified first chamber 2B or be molded thereon. The said container 1 can be designed in that it could be heated and then the said first and second substances, 21, 22, respectively, could be mixed either before or after warming the bottle contents in boiling water, or even possibly in a microwave oven.

The said seal 5 may be made of the beverage industry's commonly used seal material inside bottle caps, namely an EVA polymer consisting of at least a small portion of vinyl polymer, which is very conducive to all the functions of the said seal's 5 required performance, including being pierced and opened. A vast array of seal polymers may be used, however, besides EVA, such as Polypropylene, Polyvinyl Chloride, or even Acetates or many other polymers could effectively be used. Further, said seal's 5 outer walls 36 may be ultrasonically welded, glued or adhered in a manner typical of sealing methods used by the beverage, medical or chemical container industry, to the inner wall edge 37 of said second chamber 3.

Figure 6A:
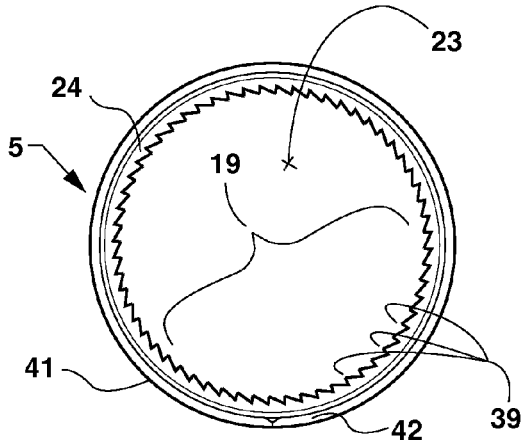
FIG. 6 comprises seal top view FIG. 6A seal side view, FIG. 6B ratchet teeth cutaway FIG. 6C, chemically adhered section FIG. 6D, and FIG. 6E and FIG. F being optional snap fit flange illustrations.
Figure 6B:
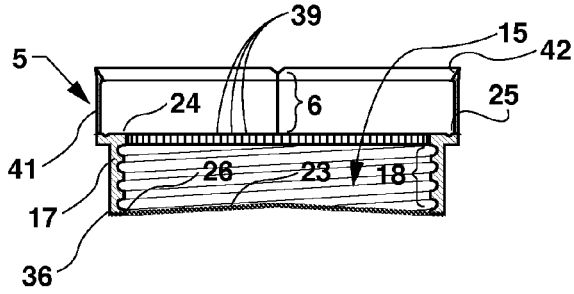
Figure 6D:
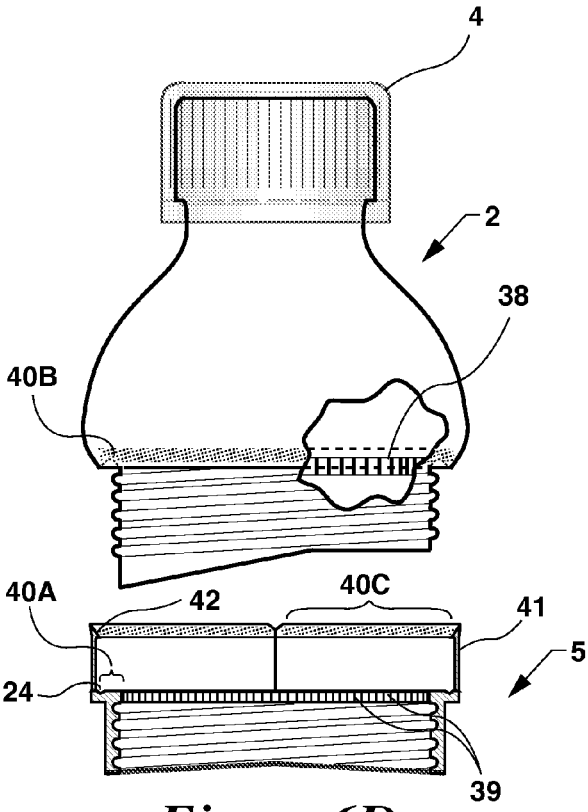
Figure 6C:
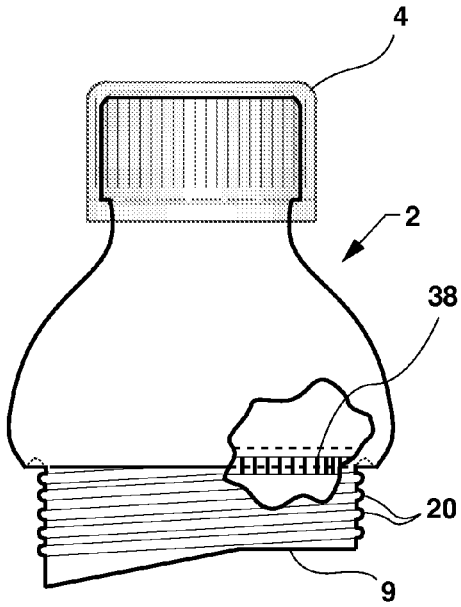
Figure 6E:
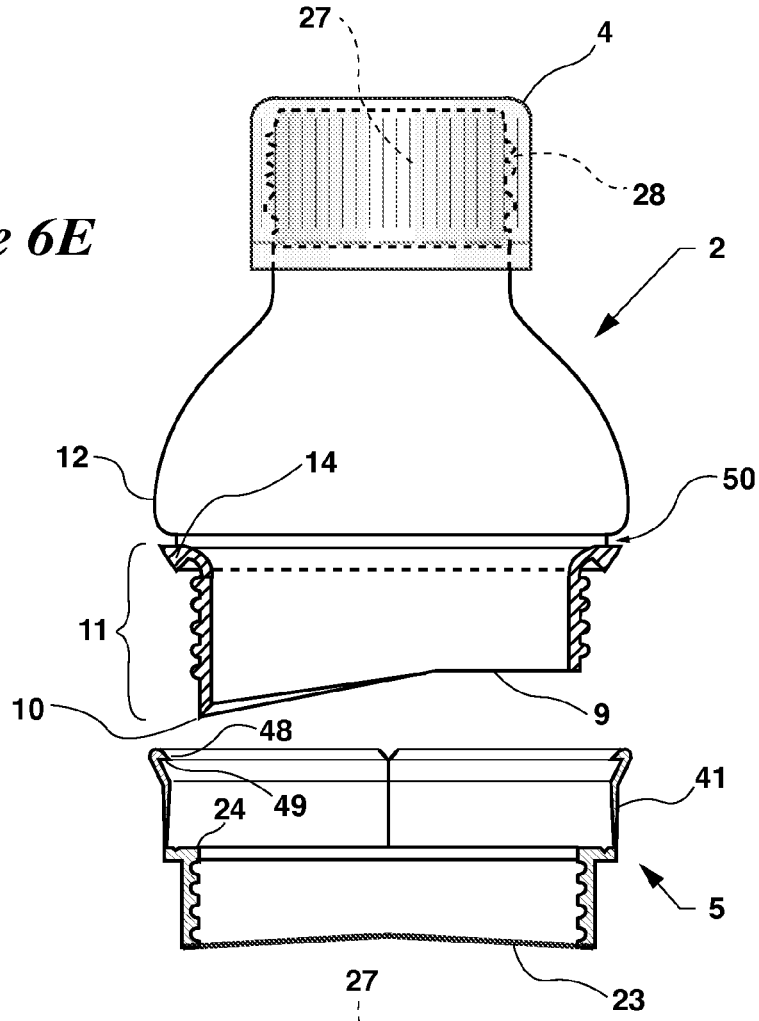
Figure 6F:
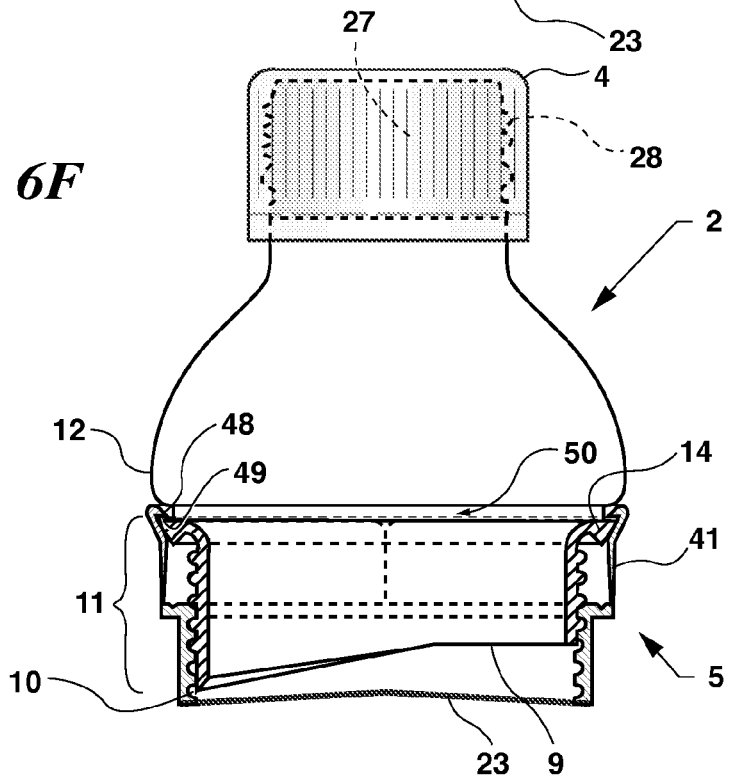

Noting FIG. 6, firstly, it may be advantageous, in the event the container 1 does not stay screwed together in a tight enough seal after activation, and, secondly, needs to have the extra benefit that the said container's 1 first chamber 2 cannot be or reversed once sealed down and reopened at the said mutually sealing areas (specifically for those embodiments that have removable said caps, as discussed in FIGS. 7B and 7C), to provide proximate or near said first chamber's open end 7 one-way ratchet teeth 38. Appropriately, the said seal 5 would include on its annular rim portion 24 corresponding, mating one-way ratchet teeth 39. Both sets of said one-way ratchet teeth may mutually engage to permit rotation of the said first and second chambers, 2, 3, respectively, with respect to each other in only one direction.

Noting FIG. 6D, the same effect of a locking rotation position after activation can be achieved by providing a chemical applied surface 40A upon said seal's annular rim portion 24 and a chemical applied surface 40B on said first chamber's open end, both surfaces being chemically bondable to one another upon mutual contact, to permit a non-rotatable sealing contact of the said first and second chambers with respect to each other after said breaking of said seal bottom 23 occurs.

The said protective seal 41 may have further advantageous modifications including being bonded in assembly proximate to the said outer periphery 11 of the said seal mating portion 12 of the said first chamber 2, so that the said protective seal 41 further tears away from the said seal rim portion 24 of the said seal 5 as twisting rotational force is applied to the said first chamber in activation of the said container 1, while said protective outer strip remains permanently adhered through adhesive 40C upon said protective strip's inner lip 42, thus adhering to the said periphery 11 of said first chamber's said seal mating portion 12, as said first and second chambers are twisted and activated. Note how this seal arrangement could enhance the shelf-life of the said substances by providing close to or a full air-tight seal of the said container 1.

Noting FIG. 1 through FIG. 7, wherein the said seal 5 further may optionally comprise a protective outer strip 41 which tears away from the said seal rim portion 24 of the said seal 5 as internal bursting pressure is applied proximately from said first chamber's said seal mating portion 12 as said first and second chambers, 2, 3, respectively, are linearly moved with respect to each other. Said protective outer strip 41 further comprises an outer seal split section 6 which splits open as said first and second chambers are linearly moved with respect to each other. FIG. 2 and FIG. 2.1 illustrate the container's 1 ready-to-activate state with the said seal bottom 23 unbroken. Note the protective strip inner lip 42 as it annularly nests on and around the said seal mating portion 12 of said first chamber 2, in that there is a snug fit. This resultant detached protective outer strip 41 is clearly illustrated in FIG.

3, and the broken said seal bottom 23, preferably being a liquid seal that is sealing liquid into said second chamber 3, is illustrated as well in FIG. 3.

Note FIG. 2.2, wherein said container 1 further comprises a tamper evident outer film 45 with a perforated strip 46 located in approximate annular alignment to the said seal's 5 protective outer strip 41. Said perforated strip 46 further comprises a pull tab 47 which upon pulling allows said perforated strip to be pulled from said container 1, enabling said protective outer strip 41 to detach and allow said first chamber 2 and said second chamber 3 to be rotated, traveling linearly with respect one another, thus enabling said seal breaking element to break open said seal bottom and said substances to mix.

Noting FIG. 6E and FIG. 6F, said protective outer strip 41 which may further comprise a tamper-evident flange 48 with a flat upper lip 49 that cooperates with a flange receiving groove 50 proximate to the said outer periphery of the seal mating portion of the first chamber. As in the former embodiments discussed, the said 41 protective seal tears away from the said seal rim portion 24 of the said seal 5 as twisting rotational force is applied to the said chambers in activation of the container, and the said first chamber 2 and second chamber 3 are linearly moved with respect to each other. Said tamper-evident flange 8 may also be described as a tamper-evident snap-fit flange that cooperates with the said flange receiving groove 50, which itself may be further described as a snap fit flange receiving portion proximate to the said outer periphery 11 of the said seal mating portion of the said modified first chamber 2B. The unique advantage to this flanged seal arrangement is that even if there were no tamper-evident outer film, a user would know whether the said container 1 was opened, since any rotational movement in either direction, causing the said chambers moving in any direction, in any linear direction, would break the said outer seal split section 44, revealing that tampering has occurred.

As well, another advantage of the above seal arrangement is that there can be a highly effective and airtight seal provided that would not require the use of glue or other adherence means, as those mentioned in FIG. 6D, thus allowing for even a longer shelf life of the beverage, medical mixture solution or other industry mixture.

The said seal 5, may be further modified by separating it into two parts. This is illustrated in FIG. 8 and FIG. 8.1 wherein a modified second chamber 3B that may further comprise internal lip threads 52 on the inside of its said open end 19 and a seal mating portion 35 at an outer edge portion 53 at its said open end 19, and an inner seal portion 54 at an inner edge portion 51 of its said open end 19.

A disc seal 55 and a ring seal 56 is shown situated between the said open end 7 and said seal mating portion 12 of first said chamber 2 and situated within the said open end 19 and seal mating portion 35 of said second chamber 3 whereby said disc sea 55 simultaneously seals said first 21 and said second 22 substances from one another, maintaining said first and second substances in said first 2 and second chambers 3 in an unmixed state. The said disc seal 55 further comprises a breakable seal bottom 57 which is broken as said first and second chambers are linearly moved with respect to each other, thereby enabling said seal breaking element 9 to move down upon and break open said seal bottom 57.

Said ring seal 56 is further situated directly between the said open end 7 and seal mating portion 12 of first said chamber 2 and situated directly between the said open end 19 and seal mating portion of second said chamber 35. It is to be noted in FIG. 8.1 that said disc seal 57 can be sealed through a downward edge pressure upon a formed annular disc seal surface 58 provided, preferably through molding or forming such surface 58 proximate to the said modified second chamber 3B's said open end 19 and preferably underneath the modified second chamber threads 59. In FIG. 8 said disc seal 57 seals in an opposite direction, with upward pressure, instead, as it can be fitted onto an annular rim 60 proximate to the said modified second chamber 3B's said open end 19, and preferably, further underneath the said modified second chamber threads 59.

Figure 9:
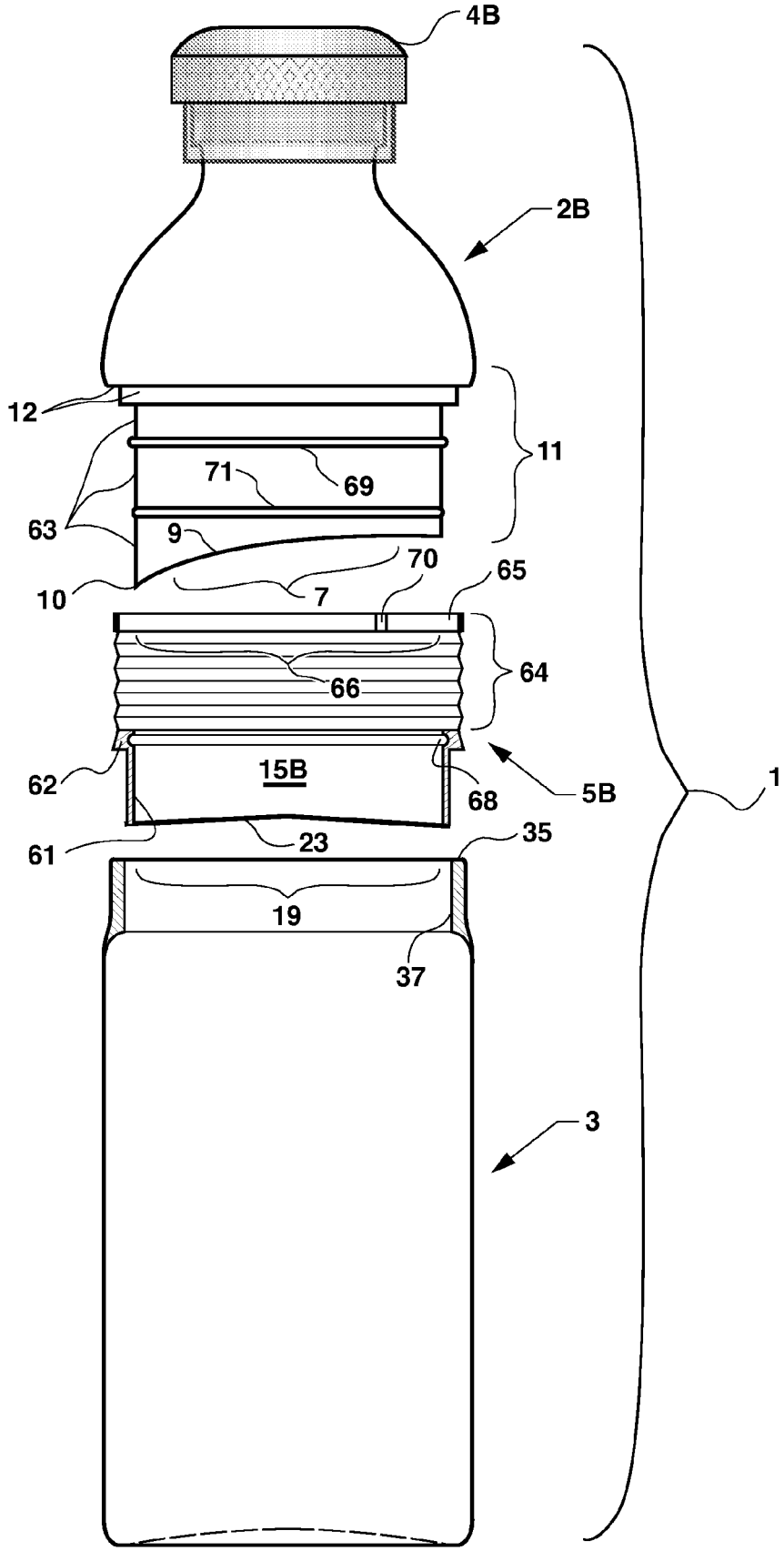
FIG. 9 is an exploded view of the present invention in a second preferred embodiment using no threaded means to activate the container.
Figure 10:
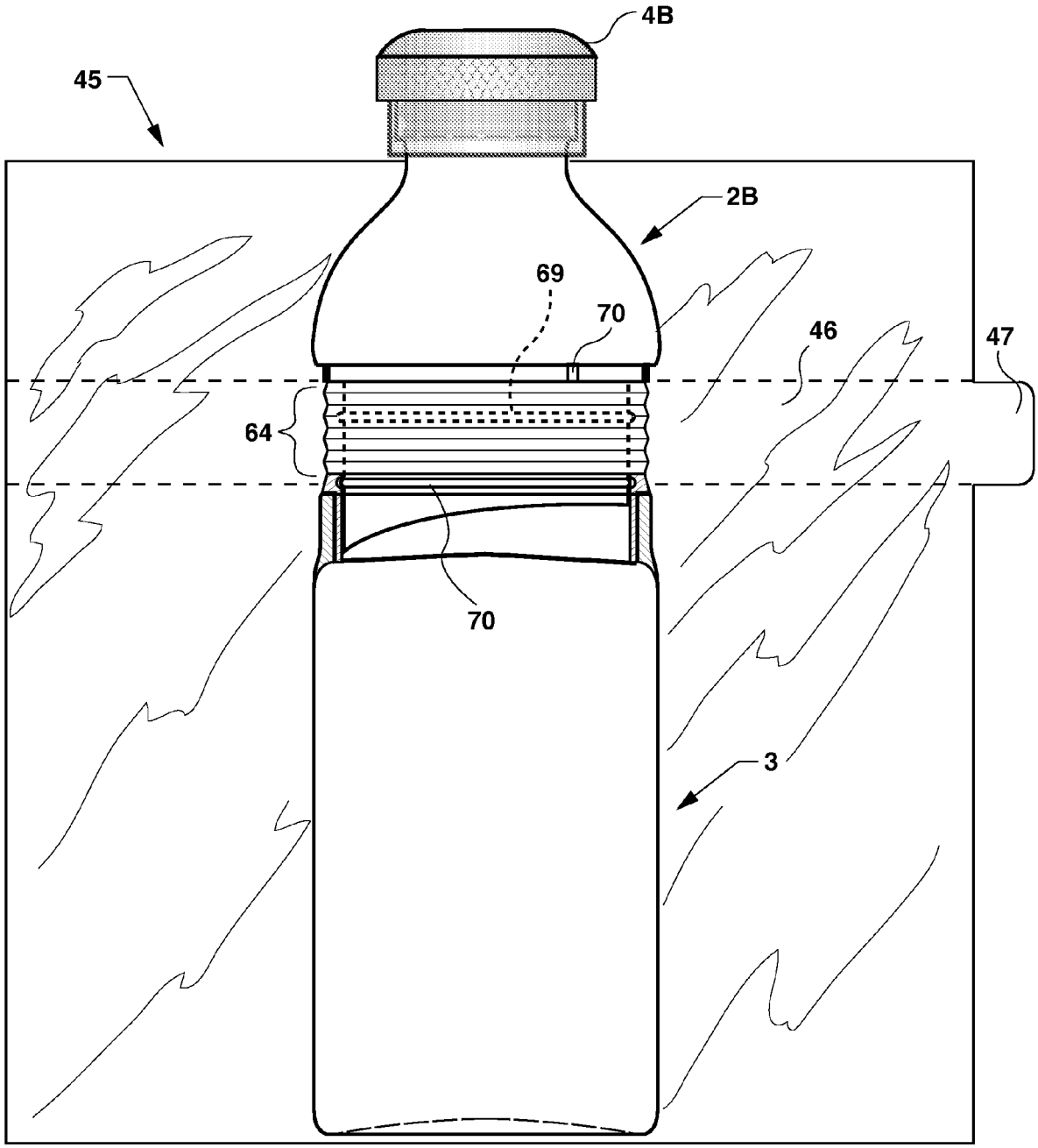
FIG. 10 is an assembled view of the present invention in a second preferred embodiment using no threaded means to activate the container.
Figure 11:
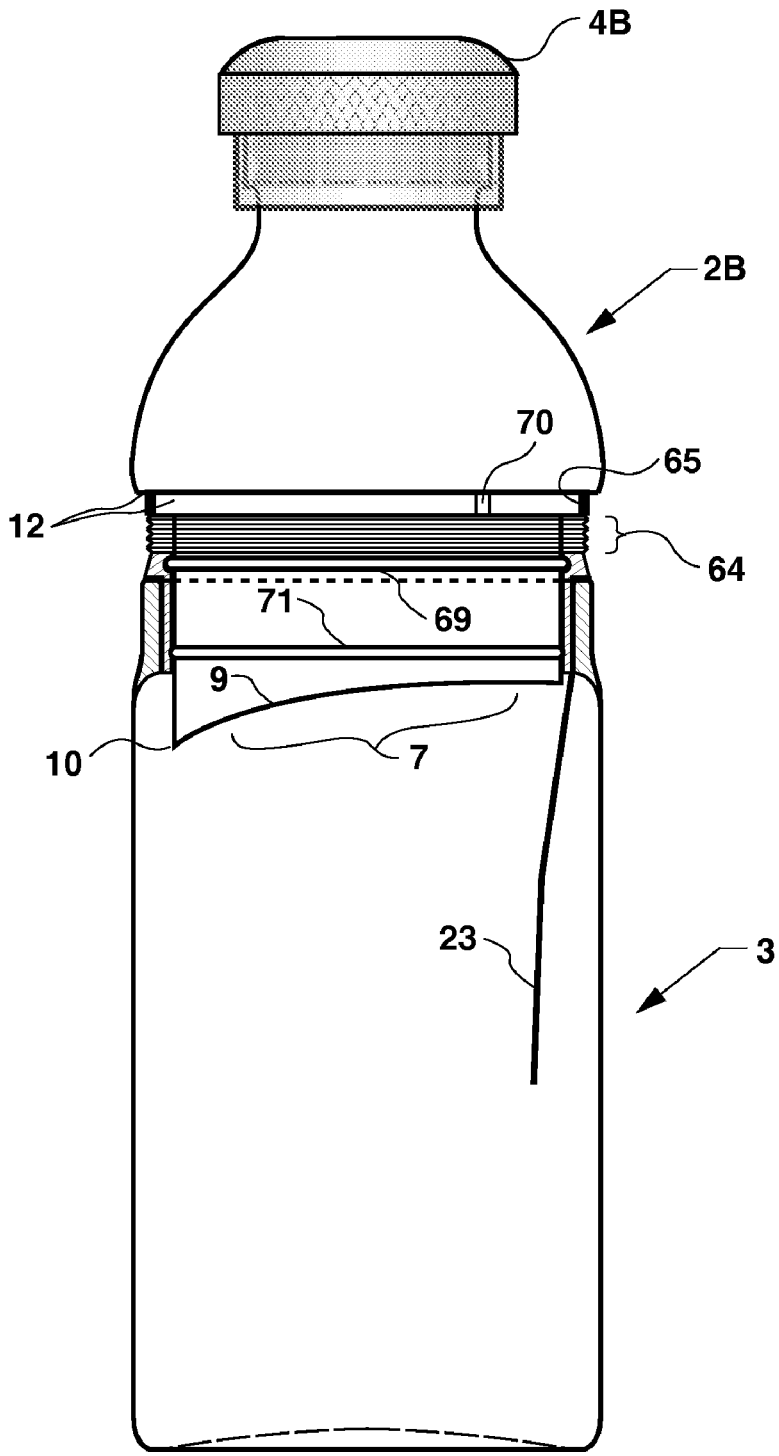
FIG. 11 is an assembled activated state view of the present invention in a second preferred embodiment using no threaded means to activate the container.

All of the above has described the preferred embodiment of the said container 1 having thread means to move the said chambers, however another embodiment that could be as equally effective and possibly even less cost to make is illustrated in FIG. 9, FIG. 10 and FIG. 11, whereby a modified seal 5B further comprises a annular bellows cavity 15B having a modified seal rim portion 62 and said inner walls 17, which have a sliding surface 61 thereon. The said container's 1 said first open end 7 of a modified first chamber 2B further comprising an outer sliding surface 63 that slidably mates with said seal's sliding surface 61, enabling the said first and second chambers to move together linearly when the said first and said second chambers are pressed together with respect one another, thus enabling activation and said seal breaking element to break open said seal bottom.

The said modified seal 5B further comprises a bellows sleeve 64 (which could be substituted with any collapsible thin film) extending from the said modified seal rim portion 62. Said bellows sleeve 64 also has a sealable opening 65 on its opposite end 66 to the said seal bottom 23. Said bellows sleeve 64 further encloses the said periphery of the first chamber's open end 11, proximate to said modified first chamber's 2B open end's said seal mating portion 12, whereat the said bellow sleeve's 64 said sealable opening 65 is sealed during production assembly of the said container.

The said periphery 11 of the said modified first chamber's 2B said open end 7, wherein the said seal braking element 9 further comprises a said lower extremity 8, also comprises at least one said cutting edge 10, where also at least one annular sealing ring 69 is proximate to said first chamber's open end 7. Said modified seal's 5B said inner walls 61 further comprise a receiving groove 68 where into the said annular sealing ring 69 may snap into position when the said seal bottom is opened by the linear movement of said cutting edge upon it. It may be beneficial to have a second annular ring 71 that is preferably of a smaller diameter than the said annular ring 69 that in assembly is positioned into the said receiving groove 68, in order to stop the said cutting edge 10 from going too far and piercing the said seal bottom 23 during insertion phase in assembly. This arrangement may also help to prevent any premature activation if the said container 1 were to be bumped or jarred during shipping and other handling. The said container 1 may further comprise a said outer tamper resistant film 45 that covers at least an outer portion the said bellows sleeve. The said film 45, similar to the former embodiment, has a said perforated strip 46 that may be torn away from said container 1, allowing for activation by a container user at time of activation by pulling said pull tab 47.

Figure 12:
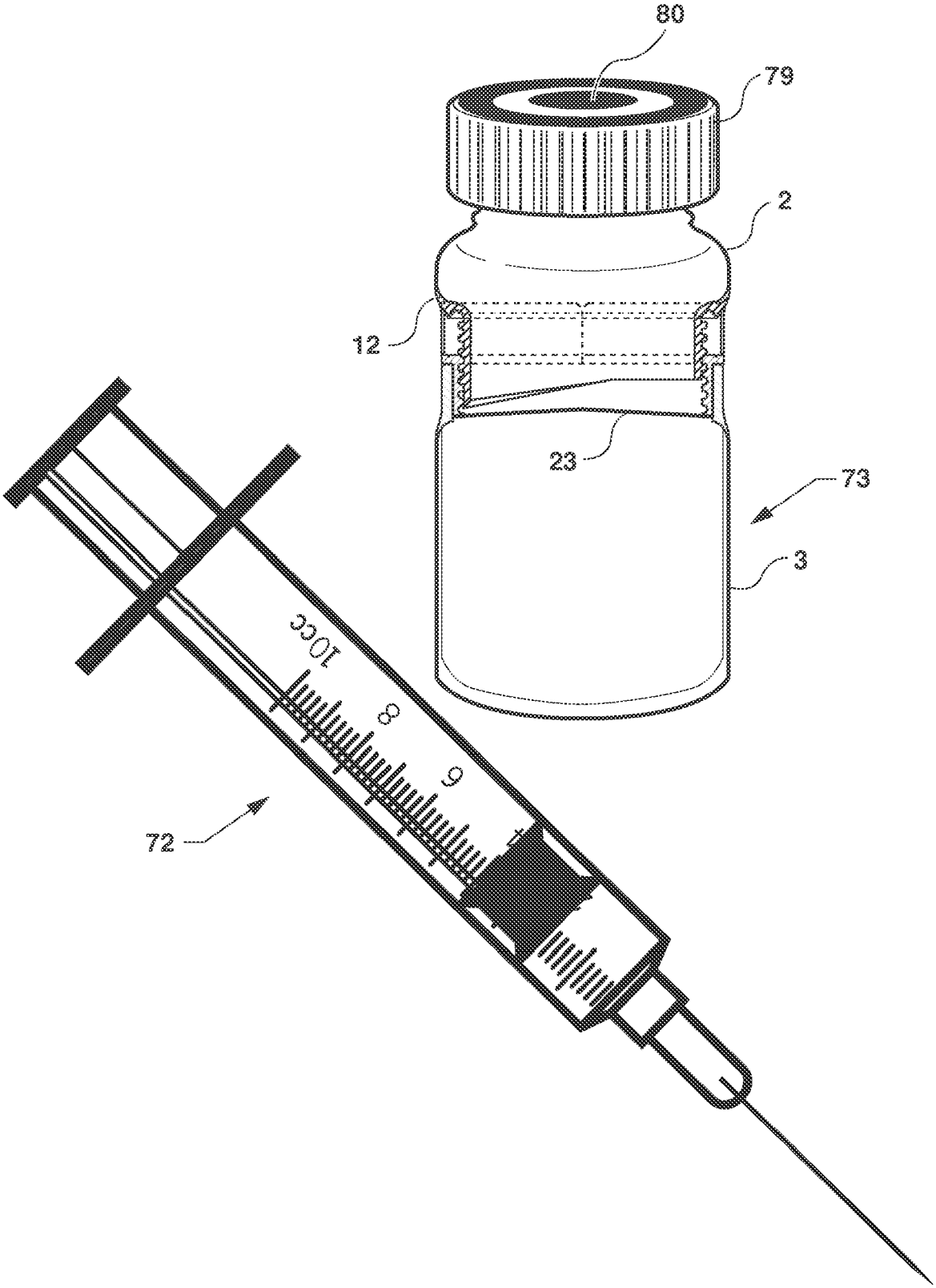
FIG. 12 is an assembled view of the present invention adapted to a syringe bottle application.

Finally, said container 1 in FIG. 12, which includes a syringe 72, is adapted to function in a syringe bottle structure 73 with sealed rim cap 79 and rubber pierce membrane 80. The medical industry often needs to keep certain drugs and medicines separate until use to keep their potency. This is especially true for treating diabetics, where insulin mixtures, if in powder form, could be mixed right at the time of injection, then the pharmaceutical potency would be at a maximum. This is true for very many of the myriad of medicinal preparations in the medical industry, including hormone treatments.

It is to be understood that the form of the invention herewith shown and described above is to be taken as preferred embodiments. Various changes maybe made in the shape, size and arrangements of the parts, for example: other equivalent elements may be substituted for those illustrated and described herein, parts and elements may be reversed and certain features of the invention may be utilized independently of the use of other features, all without departing from the spirit and scope of the invention, as defined in the subjoining claims.

What is claimed is:

1. A disposable-recyclable container having at least two separate storage chambers for storing at least two substances separately, for subsequent mixing, comprising:

(a) a first container portion forming a first chamber that may enclose a first substance; said first chamber further comprising a single-component formed chamber having an open end and a seal mating portion on its outer periphery, proximate to said open end; said first chamber's open end further having a seal breaking element that further comprises a lower extremity whereby at least one seal-breaking edge is formed on said first chamber's open end;

(b) a second container portion forming a second chamber that may enclose a second substance; said second chamber further comprising an open end and a seal mating portion at said open end;

(c) a seal situated between the said open end and seal mating portion of first said chamber and situated between the said open end and seal mating portion of second said chamber whereby said seal simultaneously seals said first and said second substances from one another permanently, structurally co-joining said first and second chambers as a single said container with said first and second substances in an unmixed state until one-time mixing activation of the said disposable-recyclable container;

(d) said seal further comprising a permanently affixed, breakable seal bottom which is broken as said first and second chambers are linearly moved with respect to each other; said seal further comprises an annular cavity having an annular seal rim portion, and inner walls further having internal threads thereon; said first container portion's first open end's outer periphery of said single-component chamber further comprises external threads that rotatably mate with said seal's internal threads, thereby enabling said seal breaking element to move down upon and break open said seal bottom as said first and second chamber are rotated with respect to each other, allowing said first and second substances to mix together as said first and said second seal mating portions meet; said container thenceforth maintaining said mixed substances in the sealed, said container, until releasing said mixed substances;

(e) said seal further comprising a protective seal that extends from said annular seal rim portion and engages said first container portion before the breakable seal bottom is broken and is free from engagement with said second container portion, wherein a bottom of the protective seal engages the annular seal rim portion and forms an air tight connection around the seal at the engagement with the annular seal rim portion, wherein the protective seal forms an air tight connection around the seal at the engagement with the first container portion.

2. The container as recited in claim 1 wherein relative movement between said first container portion and said annular seal rim portion causes said protective seal to break.

3. The container as recited in claim 1 wherein said first chamber comprises a second open end located opposite the end of said first chamber's first opening; said second opening further consisting of a substance filling opening for said first chamber of said container, wherein said breakable seal bottom remains attached to said seal after breaking such that said breakable seal bottom hangs in said second chamber from a point of attachment to said seal.

4. The container as recited in claim 3 wherein said second opening may be sealed by a cap means.

5. The container as recited in claim 4 wherein said cap means is a screw cap and wherein said substance filling opening is a threaded bottle mouth.

6. The container as recited in claim 4 wherein said cap means is a snap-fitted cap.

7. The container as recited in claim 4 wherein said cap means is a modified plug cap.

8. The container as recited in claim 1 wherein said first chamber is itself detachable from said container so that after mixing the said first and second substances, it may be removed, allowing the user to empty said container directly from said open end of said second chamber.

9. The container as recited in claim 1 wherein said seal is made of EVA material and said seal's said annular cavity further comprises outer walls that are ultrasonically welded to the said open end and said rim portion of said second chamber.

10. The container as recited in claim 1 wherein said seal's said annular cavity further comprises outer walls that are adhered to the said open end and said rim portion of said second chamber and wherein said first and said second chambers are manufactured by blow-mold processing.

11. The container as recited in claim 4 wherein said first chamber's open end further comprise one-way ratchet teeth and wherein said seal's annular rim portion comprises one-way ratchet teeth; said one-way ratchet teeth of said rim portion and said ratchet teeth of said first chamber's open end may mutually engage to permit rotation of the said first and second chambers with respect to each other in only one direction.

12. The container as recited in claim 1 wherein said first chamber's open end further includes a chemical applied surface and wherein said seal's annular rim portion comprises a chemical applied surface; said chemical applied surface of said rim portion and said chemical applied surface of said first chamber's open end being chemically bondable to one another upon mutual contact to permit a non-rotatable sealing contact of the said first and second chambers with respect to each other after said breaking of said seal bottom occurs.

13. The container as recited in claim 1 wherein said protective seal tears away from the said seal rim portion of the said seal as internal bursting pressure is applied proximate to said first chamber's said seal mating portion, as said first and second chambers are linearly moved with respect to each other.

14. The container as recited in claim 13 wherein said container further comprises a tamper evident outer film with a perforated strip located in approximate annular alignment to the said seal's protective seal; said perforated strip further comprising a pull tab which upon pulling allows said perforated strip to be pulled from said container, enabling said protective seal to detach and allow said first and said second chambers to be rotated, traveling linearly with respect one another, thus enabling said seal breaking element to break open said seal bottom and said substances to mix.

15. A disposable-recyclable container having at least two separate storage chambers for storing at least two substances separately, for subsequent mixing, comprising:

(a) a first container portion forming a first chamber that may enclose a first substance; said first chamber further comprising a single-component formed chamber having an open end and a seal mating portion, on its outer periphery, proximate to said open end; said first chamber's open end further having a seal breaking element that further comprises a lower extremity whereby at least one seal-breaking edge is formed on said first chamber's open end;

(b) a second container portion forming a second chamber that may enclose a second substance; said second chamber further comprising internal mating threads on its open end and a permanently affixed seal mating portion at an outer edge portion at its said open end and a permanently affixed inner seal portion at an inner edge portion of its said open end;

(c) a two-component permanently affixed seal comprising a permanently affixed disc seal and a permanently affixed ring seal; said disc seal further situated between the said open end and seal mating portion of first said chamber and situated within the said open end and seal mating portion of second said chamber whereby said disc seal simultaneously permanently affixed seals said first and said second substances from one another, maintaining said first and second substances in said first and second chambers in an unmixed state until one-time mixing activation of the said disposable-recyclable container; said disc seal further comprising a breakable seal bottom which is broken as said first and second chambers are linearly moved with respect to each other in a longitudinal direction of the container, thereby enabling said seal breaking element to move down upon and break open said seal bottom as said first and second chamber are rotated with respect to each other, wherein said breakable seal bottom is broken upon rotational movement and linear movement of said seal breaking element thereon, and wherein said breakable seal bottom remains attached to said disc seal after breaking such that said breakable seal bottom hangs in said second chamber from a point of attachment to said disc seal, wherein the disc seal has a center portion and an annular rim at an edge of the center portion that extends from the center portion in the longitudinal direction of the container, wherein the second container portion has an annular receiving surface and wherein the annular rim engages the annular receiving surface before the disc seal is broken;

(d) said ring seal further permanently affixed between the said open end and seal mating portion of first said chamber and permanently affixed directly between the said open end and seal mating portion of second said chamber, allowing said first and second substances to mix together, maintaining said mixed substances in a sealed said container as said first and second chambers are linearly moved with respect to each other.

16. A disposable-recyclable container having at least two separate storage chambers for storing at least two substances separately, for subsequent mixing, comprising:

(a) a first container portion forming a first chamber that may enclose a first substance; said first chamber further comprising a single-component formed chamber having an open end and a seal mating portion, on its outer periphery, proximate said open end; said first chamber's open end further having a seal breaking element that further comprises a lower extremity whereby at least one seal-breaking edge is formed on said first chamber's open end;

(b) a second container portion forming a second chamber that may enclose a second substance; said second chamber further comprising an open end and a seal mating portion at said open end;

(c) a seal situated between the said open end and seal mating portion of first said chamber and situated between the said open end and seal mating portion of second said chamber whereby said seal simultaneously seals said first and said second substances from one another permanently, structurally co-joining said first and second chambers as a single said container with said first and second substances in an unmixed state, until one-time mixing activation of the said disposable-recyclable container; said seal further comprising a breakable seal bottom which is broken as said first and second chambers are linearly moved with respect to each other, thereby enabling said seal breaking element to move down upon and break open said seal bottom;

(d) the said seal further comprising an annular bellows cavity having a modified seal rim portion and inner walls, further having a sliding surface thereon; said container's said first open end of said first chamber further comprising an outer sliding surface that slidably mates with said seal's sliding surface; and wherein the said seal breaking element further comprises an annular sealing ring proximate to said first chamber's open end; said seal's inner walls further comprising a receiving groove where the said annular sealing ring is located within said receiving groove when the said seal bottom is opened by the linear movement of said cutting edge upon it, and whereby a second annular sealing ring is also included on said seal breaking element that is located within said receiving groove when said seal bottom is closed and before being opened by said cutting edge, enabling the said first and second chambers to move together linearly when the said first and said second chambers are pressed together with respect to one another, thus enabling activation and said seal breaking element to break open said seal bottom, and wherein when said annular sealing ring is snapped into said receiving groove relative linear movement between said first and said second chambers in both directions is resisted, and wherein when said second annular sealing ring is snapped into said receiving groove relative linear movement between said first and said second chambers in both directions is resistedi wherein said second annular sealing ring is closer to said lower extremity than said annular sealing ring, wherein said second annular sealing ring is outside of and not located in said receiving groove when said seal bottom is opened by the linear movement of said cutting edge upon said seal bottom, and wherein said annular sealing ring is outside of and not located in said receiving groove when said seal bottom is closed and before being opened by said cutting edge.

17. The container as recited in claim 1 wherein said protective seal is permanently bonded in assembly proximate to the said outer periphery of the said seal mating portion of the said first chamber; the said protective seal further bursts open upon activation of the said container destroying said seal for one-time use activation of said container from the said seal rim portion of the said seal as twisting rotational force is applied to the said first chamber in activation of the said container, while said protective seal remains permanently bonded to the said periphery of said first chamber's said seal mating portion, as said first and second chambers are linearly moved with respect to each other.

18. The container as recited in claim 1 wherein said protective seal further comprises a tamper-evident flange that cooperates with a flange receiving groove proximate to the said outer periphery of the said seal mating portion of the said first chamber; the said protective seal further tears away from the said seal rim portion of the said seal as twisting rotational force is applied to the said first chamber in activation of the said container, as said first and second chambers are linearly moved with respect to each other.

19. The container as recited in claim 16 whereby said container further comprising an outer tamper resistant film that covers at least an outer portion the said bellows sleeve; said film may be torn away from said container, allowing for activation by a container user at time of activation.

20. The container as recited in claim 16 whereby said first chamber comprises a second opening located opposite the end of said first chamber's first opening; said second opening further consisting of a substance filling opening for said first chamber of said container, and wherein said second opening may be sealed by a cap means; said cap means further defined by a mushroom-contoured top screw cap and wherein said substance filling opening is a threaded bottle mouth.

21. The container as recited in claim 1 wherein said protective seal further comprises a tamper-evident snap-fit flange that cooperates with a snap fit flange receiving portion proximate to the said outer periphery of the said seal mating portion of the said first chamber; the said protective seal further tears away from the said seal rim portion of the said seal as twisting rotational force is applied to the said first chamber in activation of the said container, as said first and second chambers are linearly moved with respect to each other.

22. The container as recited in claim 16 wherein said second annular sealing ring is closer to said cutting edge than said annular sealing ring and wherein the said bellows sleeve further comprises at least one air vent.

23. The container as recited in claim 1 wherein the said disposable-recyclable container bottle comprises a modified structure to conform as a syringe injection vessel with these further limitations and structure: At the said portion wherein said first chamber comprises a second open end located opposite the end of said first chamber's first opening; said second opening is further consisting of a container sealed rim cap; said container sealed rim cap that further comprises a rubber pierce membrane for receiving a syringe needle; and wherein pharmaceutical powder may be kept separate from its irrigation liquid until necessary twist-activation mixing for maximum potency at time of injection.

24. The container as recited in claim 4 wherein said cap means comprises a baby bottle nipple thereon.

25. The container as recited in claim 4 wherein said cap means comprises a tapered squirt spout tip that has a breakable tab thereon.

26. The container as recited in claim 4 wherein said protective seal further comprises a protective seal split section which slits open as said first and second chambers are linearly moved with respect to each other.

* * * * *

UNITED STATES PATENT AND TRADEMARK OFFICE

CERTIFICATE OF CORRECTION

PATENT NO. : 8,151,985 B2
APPLICATION NO. : 11/766930
DATED : April 10, 2012
INVENTOR(S) : Greg J Owoc It is certified that error appears in the above-identified patent and that said Letters Patent is hereby corrected as shown below:

In Claim 16 at col 16 line 52, the word "resistedi" should read --resisted;--.
In Claim 26 at col 18 line 27, the number "4" should read --13--.

Signed and Sealed this
Twelfth Day of June, 2012

David J. Kappos

David J. Kappos
*Director of the United States Patent and Trademark Office*